US011154091B2

(12) United States Patent
Reevell

(10) Patent No.: US 11,154,091 B2
(45) Date of Patent: Oct. 26, 2021

(54) ELECTRICALLY OPERATED AEROSOL-GENERATING SYSTEM WITH A TUBULAR AEROSOL-GENERATING ARTICLE AND A RETAINING FEATURE

(71) Applicant: Philip Morris Products S.A., Neuchatel (CH)

(72) Inventor: Tony Reevell, London (GB)

(73) Assignee: Philip Morris Products S.A., Neuchatel (CH)

( * ) Notice: Subject to any disclaimer, the term of this patent is extended or adjusted under 35 U.S.C. 154(b) by 261 days.

(21) Appl. No.: 16/304,894

(22) PCT Filed: May 26, 2017

(86) PCT No.: PCT/EP2017/062763
§ 371 (c)(1),
(2) Date: Nov. 27, 2018

(87) PCT Pub. No.: WO2017/207435
PCT Pub. Date: Dec. 7, 2017

(65) Prior Publication Data

US 2020/0008471 A1 Jan. 9, 2020

(30) Foreign Application Priority Data

May 31, 2016 (EP) ..... 16172322

(51) Int. Cl.
*A24F 47/00* (2020.01)
*A24F 40/46* (2020.01)
(Continued)

(52) U.S. Cl.
CPC ..... *A24F 40/46* (2020.01); *A24D 1/20* (2020.01); *H05B 3/42* (2013.01); *A24F 40/20* (2020.01)

(58) Field of Classification Search
CPC ..... A24F 40/46
See application file for complete search history.

(56) References Cited

U.S. PATENT DOCUMENTS 5,144,962 A * 9/1992 Counts ..... A24F 40/46 131/194
5,498,855 A 3/1996 Deevi et al.
(Continued)

FOREIGN PATENT DOCUMENTS

CN 102781266 A 11/2012
CN 204064745 U 12/2014
(Continued)

OTHER PUBLICATIONS

International Search Report and Written Opinion dated Sep. 22, 2017 in PCT/EP2017/062763 filed May 26, 2017.
(Continued)

*Primary Examiner* — Cynthia Szewczyk
(74) *Attorney, Agent, or Firm* — Oblon, McClelland, Maier & Neustadt, L.L.P.

(57) ABSTRACT

An electrically operated aerosol-generating system is provided, including a main unit including a heating portion disposed at an outer surface of the main unit, the heating portion including one or more electric heaters; and a tubular aerosol-generating article including a tubular aerosol-forming substrate and an inner passage, wherein: the inner passage of the tubular aerosol-generating article is configured to receive the heating portion of the main unit; the one or more electric heaters are configured to heat the tubular aerosol-forming substrate when the tubular aerosol-generating article is received on the heating portion of the main unit; and at least one of the main unit and the tubular aerosol-generating article includes at least one retaining feature configured to removably retain the tubular aerosol-generating article on the heating portion of the main unit
(Continued)

when the tubular aerosol-generating article is received on the heating portion of the main unit.

13 Claims, 6 Drawing Sheets

(51) Int. Cl.

| | |
|---|---|
| ***H05B 3/42*** | (2006.01) |
| ***A24D 1/20*** | (2020.01) |
| *A24F 40/20* | (2020.01) |

(56) References Cited

U.S. PATENT DOCUMENTS

| | | | | |
|---|---|---|---|---|
| 5,514,630 | A | 5/1996 | Willkens et al. | |
| 2009/0095311 | A1* | 4/2009 | Han | A24F 40/46 131/194 |
| 2011/0155718 | A1 | 6/2011 | Greim et al. | |
| 2014/0064715 | A1 | 3/2014 | Greim et al. | |
| 2014/0261495 | A1* | 9/2014 | Novak, III | H05B 3/46 131/329 |
| 2014/0360515 | A1* | 12/2014 | Vasiliev | A24F 40/50 131/329 |
| 2015/0181936 | A1 | 7/2015 | Lyubomirskiy et al. | |
| 2015/0335071 | A1* | 11/2015 | Brinkley | H05B 1/0297 131/328 |
| 2016/0360785 | A1* | 12/2016 | Bless | A24F 47/008 |
| 2016/0374145 | A1 | 12/2016 | Greim et al. | |
| 2017/0143041 | A1 | 5/2017 | Batista et al. | |
| 2017/0143042 | A1 | 5/2017 | Batista et al. | |

FOREIGN PATENT DOCUMENTS

| | | | |
|---|---|---|---|
| CN | 204907938 | U | 12/2015 |
| EP | 2 316 286 | A1 | 5/2011 |
| JP | H05-164117 | A | 6/1993 |
| JP | 3071682 | U | 9/2000 |
| JP | 3112357 | U | 8/2005 |
| JP | 2013-509160 | A | 3/2013 |
| RU | 2014 135 388 | A | 3/2016 |
| WO | WO 03/095688 | A2 | 11/2003 |
| WO | WO 2011/079933 | A1 | 7/2011 |
| WO | WO 2016/005600 | A1 | 1/2016 |
| WO | WO 2016/005601 | A1 | 1/2016 |

OTHER PUBLICATIONS

Russian Federation Office Action dated Sep. 23, 2020 in Patent Application No. 2018144295/03(073840) (with English translation), citing document AO therein, 14 pages.

Combined Chinese Office Action and Search Report dated Feb. 1, 2021 in Chinese Patent Application No. 201780028192.9 (with English translation), citing documents AO-AQ therein, 21 pages.

Japanese Office Action dated Apr. 26, 2021 in corresponding Japanese Patent Application No. 2018-556803 (with English translation), 5 pages.

* cited by examiner

ELECTRICALLY OPERATED AEROSOL-GENERATING SYSTEM WITH A TUBULAR AEROSOL-GENERATING ARTICLE AND A RETAINING FEATURE

The present invention relates to an electrically operated aerosol-generating system. In particular, the present invention relates to an electrically operated aerosol-generating system comprising a tubular aerosol-generating article and a main unit.

Known handheld electrically operated aerosol-generating systems typically comprise an aerosol-generating device or a main unit comprising a battery, control electronics and an electric heater for heating an aerosol-generating article designed specifically for use with the aerosol-generating device. In some examples, the aerosol-generating article comprises an aerosol-forming substrate, such as a tobacco rod or a tobacco plug. Aerosol-forming substrates, such as tobacco, typically comprise one or more volatile compounds that form an aerosol when heated inside the aerosol-generating device. The heater contained within the aerosol-generating device is inserted into or around the aerosol-forming substrate when the aerosol-generating article is inserted into the aerosol-generating device. In some electrically operated aerosol-generating systems, the aerosol-generating article may comprise a capsule containing an aerosol-forming substrate, such as loose tobacco.

It would be desirable to provide an improved electrically operated aerosol-generating system comprising an aerosol-generating article and a main unit.

According to a first aspect of the present invention, there is provided an electrically operated aerosol-generating system comprising a main unit and a tubular aerosol-generating article. The tubular aerosol-generating article comprises a tubular aerosol-forming substrate having an inner passage. The main unit comprises a heating portion at an outer surface of the main unit, the heating portion having one or more electric heaters. The inner passage of the tubular aerosol-forming substrate is configured to receive the heating portion of the main unit and the one or more electric heaters of the heating portion of the main unit are arranged to heat the tubular aerosol-forming substrate when the tubular aerosol-generating article is received on the heating portion of the main unit. At least one of the main unit and the tubular aerosol-generating article comprises retaining means configured to removably retain the tubular aerosol-generating article on the heating portion of the main unit when the tubular aerosol-generating article is received on the heating portion. The retaining means is provided in in the form of at least one retaining feature.

As used herein, the term 'aerosol-generating article' is used to describe an article comprising an aerosol-forming substrate that, when heated, releases volatile compounds that can form an aerosol.

As used herein, the term 'main unit' is used to describe a device that interacts with a tubular aerosol-generating article to generate an aerosol. The main unit typically includes a supply of electrical energy and associated electric circuitry to operate the one or more heating elements.

As used herein, the terms 'inner' and 'outer' refer to relative positions of parts of the tubular aerosol-generating article or the main unit.

As used herein, the term 'inner surface' refers to a surface of an article or a main unit that faces towards the interior of the article or main unit. For example, the inner passage of the tubular aerosol-generating article may be defined by an inner surface. Likewise, the term 'outer surface' refers to a surface of an article or a main unit that faces towards the exterior or outwardly from the system. For example, the heating portion of the main unit is arranged at an outer surface of the main unit. As such, the one or more electric heaters are arranged at the outer surface of the main unit and may be visible to a user when a tubular aerosol-generating article is not received on the heating portion of the main unit.

The at least one retaining feature may inhibit or prevent accidental removal of the tubular aerosol-generating article from the heating portion of the main unit. The at least one retaining feature may enable the aerosol-generating system to be held by a user in any orientation without the aerosol-generating article sliding or falling off the tubular aerosol-generating article. The at least one retaining feature may maintain the desired arrangement of the tubular aerosol-forming substrate relative to the one or more electric heaters of the heating portion of the main unit during use of the aerosol-generating system. This may improve the conductive-heat transfer from the one or more electric heaters to the tubular aerosol-forming substrate.

The at least one retaining feature may be configured such that application of a moderate force on the tubular aerosol-generating article, by a user, is required to remove the tubular aerosol-generating article from the heating portion of the main unit. The at least one retaining feature may be configured such that application of a force greater than the weight of the tubular aerosol-generating article on the tubular aerosol-generating article is required to remove the tubular aerosol-generating article from the main unit. The at least one retaining feature may be configured such that application of a moderate force on the tubular aerosol-generating article, by a user, in a direction substantially parallel to the length of the heating portion of the main unit, may be required to remove the tubular aerosol-generating article from the main unit. The at least one retaining feature may be configured such that application of a moderate force on the tubular aerosol-generating article, by a user, in a direction substantially perpendicular to the length of the heating portion of the main unit, may be required to remove the tubular aerosol-generating article from the main unit.

The at least one retaining feature may comprise any suitable features for removably retaining the tubular aerosol-generating article on the heating portion of the main unit. The tubular aerosol-generating article may comprise the at least one retaining feature. The main unit may comprise the at least one retaining feature, or it may comprise some of the retaining features. Both the tubular aerosol-generating article and the main unit may comprise at least one retaining feature.

The at least one retaining feature may include one or more of the following: protrusions, recesses, magnetic materials, or resilient biasing. The at least one retaining feature may also include any other suitable features.

Where the tubular aerosol-generating article and the main unit both comprise at least one retaining feature, the at least one retaining feature of the main unit may be configured to cooperate with the at least one retaining feature of the tubular aerosol-generating article when the tubular aerosol-generating article is received on the heating portion of the main unit. For example, the tubular aerosol-generating article may comprise a male or female screw thread and the main unit may comprise a complementary female or male screw thread. The screw thread of the main unit may be configured to engage with the complementary screw thread of the tubular aerosol-generating article when the tubular aerosol-generating article is received on the heating portion of the main unit. In another example, the tubular aerosol-generating article may comprise a male or female bayonet connector and the main unit may comprise a complementary female or male bayonet connector. The bayonet connector of the main unit may be configured to engage with the complementary bayonet connector of the tubular aerosol-generating article when the tubular aerosol-generating article is received on the heating portion of the main unit.

Providing retaining features on the main unit and not on the tubular aerosol-generating article may enable the structure of the tubular aerosol-generating article to be kept simple, with few components. This may enable straightforward manufacture of the tubular aerosol-generating article. This may enable the tubular aerosol-generating article to be manufactured at low cost. This may reduce the cost of multiple uses of the aerosol-generating system for a user, in particular where each aerosol-generating article is configured to be disposable after a single use.

Where the main unit comprises the at least one retaining feature, the at least one retaining feature may be arranged at or towards the heating portion of the main unit. The at least one retaining feature may be arranged at or towards the proximal end of the main unit. The at least one retaining feature may be arranged proximal to the heating portion. The at least one retaining feature may be arranged between the heating portion and the proximal end of the main unit. The at least one retaining feature may be arranged distal to the heating portion. The at least one retaining feature may be arranged between the heating portion and the distal end of the main unit. In some embodiments, the main unit may comprise a shoulder between the heating portion and the distal portion of the main unit. The at least one retaining feature may be provided at or towards the shoulder. In embodiments with more than one retaining features, the retaining features may be arranged in one or more of the locations described above.

As used herein, the terms 'proximal' and 'distal' are used to describe the relative positions of components or portions of the aerosol-generating system, aerosol-generating article or main unit of the invention. As used herein, the 'proximal' end of the system is the end on which a user may draw on in use in order to inhale an aerosol generated by the aerosol-generating system. The 'proximal' end may also be referred to as the mouth end. The 'distal' end of the aerosol-generating system is the end opposite to the 'proximal' end. The 'distal' end is the end that is furthest from the user in use.

The main unit may comprise one or more protrusions. The at least one retaining feature may comprise the one or more protrusions. The one or more protrusions may be configured to engage with the tubular aerosol-generating article when the tubular aerosol-generating article is received on the heating portion of the main unit. The one or more protrusions may extend from the main unit in a direction inclined from the direction of the length of the heating portion of the main unit. The one or more protrusions may extend in a direction substantially perpendicular to the direction of the length of the heating portion of the main unit. The one or more protrusions may extend substantially radially outward.

The one or more protrusions may be arranged at any suitable position on the main unit. The one or more protrusions may be arranged at the proximal end of the main unit. The one or more protrusions may be arranged proximal to the heating portion. The one or more protrusions may be arranged distal to the heating portion.

The main unit may have a width at the one or more protrusion that is greater than the width of the heating portion. As such, the width of the main unit at the one or more protrusions may be greater than the width of the inner passage of the tubular aerosol-generating article.

As used herein, the term 'width' is used to describe the maximum dimension in the transverse direction of the aerosol-generating system, the tubular aerosol-generating article and the main unit. When used herein, the term 'length' is used to describe the maximum dimension in the longitudinal direction of the aerosol-generating system, the tubular aerosol-generating article and the main unit.

As used herein, the term 'longitudinal' is used to describe the direction between the proximal or mouth end and the distal end of the aerosol-generating system and the term 'transverse' is used to describe the direction perpendicular to the longitudinal direction.

The one or more protrusions may be configured to engage with the tubular aerosol-generating article when the tubular aerosol-generating article is received on the heating portion of the main unit. The one or more protrusions may act as a stop to inhibit removal of the tubular aerosol-generating article from the heating portion of the main unit. The one or more protrusions may be arranged to inhibit movement of the tubular aerosol-generating article in a proximal direction relative to the main unit. For example, where the one or more protrusions are arranged proximal to the heating portion, the proximal end of the tubular aerosol-generating article may abut the one or more protrusions when the tubular aerosol-generating article is received on the heating portion. This may inhibit removal of the tubular aerosol-generating article from the heating portion of the main unit.

The one or more protrusions may substantially circumscribe the main unit. In other words, the one or more protrusions may form an enlarged portion, such as a lip, extending around the circumference of the main unit.

The one or more protrusions may be configured to retract when the tubular aerosol-generating article is moved over the one or more protrusions, in a distal direction relative to the main unit, towards the heating portion of the main unit. In other words, the one or more protrusions may be configured to move or deform radially inward relative to the main unit when the main unit is inserted into the inner passage of the tubular aerosol-generating article. The one or more protrusions may be deformable. The one or more protrusions may be compressible or bendable. The one or more protrusions may be resilient. The one or more protrusions may be biased to return to the un-retracted or un-deformed configuration when the tubular aerosol-generating article is fully received on the heating portion.

The main unit may comprise means to retract the one or more protrusions. In other words, the main unit may comprise means to move or deform the one or more protrusions radially inward relative to the main unit so that the main unit may be inserted into the inner passage of the tubular aerosol-generating article or removed from the inner passage of the tubular aerosol-generating article. The retracting means may be user operated. This may enable the user to control when the tubular aerosol-generating article is removed from the heating portion of the main unit.

The tubular aerosol-generating article may be flexible or deformable, as described in more detail in a later section of the specification. In particular, the inner passage of the tubular aerosol-generating article may be deformable. The tubular aerosol-generating article may be configured to deform such that the width of the inner passage may be increased to accommodate the one or more protrusions of the main unit when the main unit is inserted into the inner passage of the tubular aerosol-generating article and removed from inner passage of the tubular aerosol-generating article. The tubular aerosol-generating article may be resilient. The tubular aerosol-generating article may be configured to return to the un-deformed configuration when the tubular aerosol-generating article is fully received on the heating portion.

Where the main unit comprises one or more protrusions, the tubular aerosol-generating article may comprise one or more recesses. The one or more recesses may be configured to receive the one or more protrusions when the tubular aerosol-generating article is received on the heating portion of the main unit. The one or more recesses may be in the inner passage of the tubular aerosol-generating article. The one or more recesses may be formed in the inner surface of the inner passage of the tubular aerosol-generating article.

The inner passage of the tubular aerosol-generating article may comprise two open ends. In other words, the tubular aerosol-generating article may comprise an open-ended hollow tube. Each open end of the inner passage may be configured to receive the heating portion of the main unit.

Where the inner passage of the tubular aerosol-generating article comprises two open ends configured to receive the heating portion of the main unit, the tubular aerosol-generating article may comprise one or more recesses arranged towards the middle of the length of the tubular aerosol-generating article. The main unit may also comprise one or more protrusions arranged towards the middle of the length of the heating portion. This may enable the one or more protrusions of the main unit to be received in the one or more recesses of the tubular aerosol-generating article when the main unit is inserted into either open end of the tubular aerosol-generating article and the tubular aerosol-generating article is fully received on the heating portion.

Where the inner passage of the tubular aerosol-generating article comprises two open ends configured to receive the heating portion of the main unit, the tubular aerosol-generating article may comprise one or more pairs of recesses. Each pair of recesses may comprise a first recess and a second recess arranged symmetrically about the middle of the length of the inner passage. This may enable the main unit to be inserted into either open end of the tubular aerosol-generating article and the one or more protrusions to be received in a recess of the tubular aerosol-generating article when the article is fully received on the heating portion. The main unit may also comprise one or more pairs of protrusions. Each pair of protrusions may comprise a first protrusion and a second protrusion arranged symmetrically about the middle of the length of the heating portion.

The at least one retaining feature may comprise one or more magnetic materials. The term 'magnetic material' is used herein to describe a material which is able to interact with a magnetic field, including both paramagnetic and ferromagnetic materials. A magnetic material may be a paramagnetic material, such that it only remains magnetised in the presence of an external magnetic field. A magnetic material may be a material which becomes magnetised in the presence of an external magnetic field and which remains magnetised after the external field is removed (such as a ferromagnetic material, for example). The term 'magnetic material' as used herein encompasses both types of magnetisable material, as well as material which is already magnetised.

The at least one retaining feature may comprise a first magnetic material arranged on the tubular aerosol-generating article and a second magnetic material arranged on the main unit. The second magnetic material may be configured to magnetically attract the first magnetic material. The first magnetic material and the second magnetic material may be arranged such that the first magnetic material is adjacent to or in close proximity to the second magnetic material when the tubular aerosol-generating article is received on the heating portion of the main unit. The first magnetic material may be arranged to abut or contact the second magnetic material when the tubular aerosol-generating article is received on the heating portion of the main unit. In this arrangement, the attractive magnetic force between the first magnetic material and the second magnetic material may be sufficient to inhibit removal of the tubular aerosol-generating article from the heating portion of the main unit when the tubular aerosol-generating article is received on heating portion of the main unit.

The first and second magnetic materials may be shaped and arranged such that application of a moderate force on the tubular aerosol-generating article, by a user, may remove the tubular aerosol-generating article from the heating portion of the main unit.

The first and second magnetic materials may comprise any suitable magnetic materials. The first and second magnetic materials may comprise the same magnetic material. The first and second magnetic materials may comprise different magnetic materials. The first and second materials may each comprise a single magnetic material. The first and second magnetic materials may each comprise a mixture of different magnetic materials. Suitable magnetic materials include iron, cobalt, nickel, barium ferrite, strontium ferrite, cobalt ferrite, rare earth cobalt materials (samarium pentacobalt, praseodymium pentacobalt, yttrium pentacobalt, lanthanum pentacobalt, and cerium-pentacobalt, for example), manganese-bismuth, and manganese-aluminium.

The first and second magnetic materials may be strips of magnetic material. The first and second magnetic materials may be strips of foil. The first and second magnetic materials may be formed from the same magnetic material. The first and second magnetic materials may be formed from different magnetic materials.

The first magnetic material may be arranged at any suitable position on the tubular aerosol-generating article. The first magnetic material may be arranged at or towards an end of the tubular aerosol-generating article. The first magnetic material may be arranged at an end face of the tubular aerosol-generating article. The first magnetic material may be arranged at the inner surface of the inner passage of the tubular aerosol-generating article. The first magnetic material may be arranged at or towards an end of the inner passage. The first magnetic material may be arranged at or towards the middle of the length of the inner passage. Where the inner passage of the tubular aerosol-generating article comprises two open ends configured to receive the heating portion of the main unit, the first magnetic material may be arranged at or towards both ends of the tubular aerosol-generating article.

The first magnetic material may be any suitable shape. The first magnetic material may be elongate. The first magnetic material may comprise one or more elongate strips. The one or more elongate strips may be arranged at the inner surface of the inner passage. The one or more elongate strips may extend substantially the length of the inner passage. The first magnetic material may be substantially annular. The first magnetic material may comprise one or more annular rings. The one or more rings of the first magnetic material may substantially circumscribe a portion of the inner surface of the inner passage. The one or more rings of the first magnetic material may substantially circumscribe a portion of at least one end face of the tubular aerosol-generating article.

The second magnetic material may be arranged at any suitable position on the main unit. The second magnetic material may be arranged at the outer surface of the main unit. The second magnetic material may be arranged at or towards the proximal end of the main unit. The second magnetic material may be arranged proximal to the heating portion. The second magnetic material may be arranged at or towards the heating portion of the main unit. The second magnetic material may be arranged at or towards an end of the heating portion. The second magnetic material may be arranged distal to the heating portion. Where the main unit comprises a shoulder between the heating portion and the distal portion of the main unit, the second magnetic material may be arranged at the shoulder.

The second magnetic material may be any suitable shape. The second magnetic material may be elongate. The second magnetic material may comprise one or more elongate strips. The one or more elongate strips may be arranged at the outer surface of main unit. The one or more elongate strips may extend substantially the length of the heating portion. The second magnetic material may be substantially annular. The second magnetic material may comprise one or more annular rings. The one or more rings of the second magnetic material may substantially circumscribe a portion of the outer surface of the main unit. Where the main unit comprises a shoulder between the heating portion and a distal portion of the main unit, the second magnetic material may comprise one or more rings substantially circumscribing a portion of the shoulder.

The first magnetic material and the second magnetic material may be arranged at complementary positions on the tubular aerosol-generating article and the main unit respectively. The first magnetic material and the second magnetic material may be arranged such that the distance between the first magnetic material and the second magnetic material is small or minimal when the tubular aerosol-generating article is received on the heating portion. For example, where the second magnetic material is arranged at the middle of the length of the heating portion, the first magnetic material may be arranged at least at the middle of the length of the inner passage.

Providing at least one of a ring of the first magnetic material and a ring of the second magnetic material may eliminate the need to maintain a specific rotational orientation of the tubular aerosol-generating article relative to the main unit upon insertion of the main unit into the inner passage of the tubular aerosol-generating article.

The main unit may comprise one or more electromagnets. The one or more electromagnets may replace the second magnetic material. The one or more electromagnets may be configured to attract the first magnetic material of the tubular aerosol-generating article when the tubular aerosol-generating article is received on the heating portion of the main unit. The one or more electromagnets may be shaped and arranged similarly to the second magnetic material.

The main unit may comprise electric circuitry configured to control the supply of power to the one or more electromagnets. The electric circuitry may be configured to supply power to the one or more electromagnets when the tubular aerosol-generating article is received on the heating portion. The electric circuitry may be configured to supply power to the one or more electromagnets when power is supplied to the one or more electric heaters. The electric circuitry may be arranged to sense the temperature of the one or more electric heaters. The electric circuitry may be configured to supply power to the one or more electromagnets until the sensed temperature of the one or more electric heaters falls below a predetermined threshold. This may ensure that a user may not remove the tubular aerosol-generating article from the heating portion during use of the aerosol-generating system.

The tubular aerosol-generating article may comprise means for applying force, radially inwardly on the heating portion of the main unit. In other words, the tubular aerosol-generating article may comprise means for gripping the heating portion of the main unit.

For example, the tubular aerosol-generating article may be deformable. The tubular aerosol-generating article may be deformable between a use configuration and a storage configuration. In the use configuration, the inner passage of the tubular aerosol-generating article is configured to receive the heating portion of a main unit. In the storage configuration, the article may be flattened. In the storage configuration, the aerosol-generating article may be substantially flat. In the storage configuration, the article may comprise substantially planar faces. In the storage configuration, the inner passage may be substantially closed, such that the inner passage may not be configured to receive the heating portion of the main unit.

In other words, the tubular aerosol-generating article may be collapsed or flattened from the use configuration to the storage configuration. This may enable close stacking of aerosol-generating articles in the storage configuration. This may reduce the space required to store and transport the tubular aerosol-generating articles. This may reduce the amount of packaging material required to package the tubular aerosol-generating articles.

The tubular aerosol-generating article may comprise one or more deformable portions. The one or more deformable portions may be configured to enable the tubular aerosol-generating article to deform between the storage configuration and the use configuration. For example, the tubular aerosol-generating article may comprise one or more pairs of deformable portions arranged at opposing side of the tubular aerosol-generating article. The one or more pairs of deformable portions may extend along the length of the tubular aerosol-generating article. The one or more deformable portions may comprise a compressible material. As such, the deformable portions may be compressible into the storage configuration to flatten the tubular aerosol-generating article and may be expandable into the use configuration to.

The tubular aerosol-generating article may be resilient. The tubular aerosol-generating article may be resiliently biased from the use configuration towards the storage configuration. In other words, the resilient tubular aerosol-generating article may be biased to return to the storage configuration. As such, the deformable aerosol-generating article may be configured to exert a force radially inward towards the heating portion of the main unit when the tubular aerosol-generating article is received on the heating portion of the main unit. The radially inward force may facilitate retention the tubular aerosol-generating article on the heating portion The aerosol-generating system of the present invention comprises a tubular aerosol-generating article comprising a tubular aerosol-forming substrate. The tubular configuration of the aerosol-generating article and the aerosol-forming substrate may facilitate improved conductive heat transfer from the one or more electric heaters of the main unit to the aerosol-forming substrate. The tubular aerosol-forming substrate may have a larger surface area to volume ratio than a conventional body or a plug of aerosol-forming substrate of equivalent size, without an inner passage. The tubular shape of the aerosol-forming substrate may reduce the maximum thickness of the aerosol-forming substrate. This may facilitate propagation of heat through the aerosol-forming substrate. This may facilitate aerosol generation.

The tubular aerosol-generating article may be any suitable shape and size. The tubular aerosol-generating article may be substantially cylindrical. The tubular aerosol-generating article may be substantially elongate. The tubular aerosol-generating article may comprise a cylindrical open-ended hollow tube of aerosol-forming substrate. The tubular aerosol-generating article may have any suitable cross-section. For example, the cross-section of the tubular aerosol-generating article may be substantially circular, cylindrical, square or rectangular.

The tubular aerosol-generating article may have a width of between about 5 mm and about 20 mm, between about 5 mm and about 12 mm or about 8 mm.

The tubular aerosol-generating article may have a length of between about 10 mm and about 100 mm, or between about 10 mm and about 50 mm, between about 30 mm and about 60 mm or about 45 mm.

The length of the tubular aerosol-generating article may be substantially similar to the length of the heating portion of the main unit. The length of the tubular aerosol-generating article may be equal to or greater than the length of the heating portion of the main unit such that tubular aerosol-generating article covers the one or more electric heaters when the tubular aerosol-generating article is received on the heating portion of the main unit.

The tubular aerosol-generating article comprises an inner passage. As used herein, the term 'inner passage' refers to a passage extending through at least part of the article. The inner passage may be surrounded by an annular body and may extend substantially along a longitudinal axis of the article.

The inner passage of the tubular aerosol-generating article may be any suitable shape and may have any suitable cross-section. For example, the cross-section of the inner passage may be substantially circular, cylindrical, square or rectangular.

The inner passage may be arranged substantially centrally in the tubular aerosol-generating article. As such, the thickness of the tubular aerosol-forming substrate may be substantially consistent around the circumference of the tubular aerosol-generating article. This may enable even heating of the tubular aerosol-forming substrate about the circumference of the tubular aerosol-generating article.

The inner passage may have a width of between about 2 mm and about 18 mm, between about 2 mm and about 10 mm or about 4 mm.

The width of the inner passage of the tubular aerosol-generating article may be substantially similar to the width of the heating portion of the main unit. As such, the inner surface of the inner passage may contact or abut the outer surface of the heating portion of the main unit when the tubular aerosol-generating article is received on the heating portion of the main unit. The width of the inner passage of the tubular aerosol-generating article may be smaller than the width of the heating portion of the main unit, such that the tubular aerosol-generating article is received on the heating portion with a friction or an interference fit.

The tubular aerosol-forming substrate may be a solid aerosol-forming substrate. The tubular aerosol-forming substrate may be a solid aerosol-forming substrate at room temperature. The tubular aerosol-forming substrate may comprise a tobacco-containing material containing volatile tobacco flavour compounds which are released from the substrate upon heating. The tubular aerosol-forming substrate may comprise a non-tobacco material. The tubular aerosol-forming substrate may comprise tobacco-containing material and non-tobacco containing material.

The solid aerosol-forming substrate may comprise, for example, one or more of: powder, granules, pellets, shreds, strands, strips or sheets containing one or more of: herb leaf, tobacco leaf, tobacco ribs, expanded tobacco and homogenised tobacco.

The solid aerosol-forming substrate may contain tobacco or non-tobacco volatile flavour compounds, which are released upon heating of the solid aerosol-forming substrate.

The solid aerosol-forming substrate may be provided on or embedded in a thermally stable carrier. The carrier may take the form of powder, granules, pellets, shreds, strands, strips or sheets. The solid aerosol-forming substrate may be deposited on the entire surface of the carrier. The solid aerosol-forming substrate may be deposited in a pattern to provide a non-uniform flavour delivery during use.

The tubular aerosol-forming substrate may comprise a gathered textured sheet of homogenised tobacco material. The tubular aerosol-forming substrate may comprise a gathered textured sheet of homogenised tobacco material comprising one or more of a plurality of spaced-apart indentations, protrusions and perforations. Use of a textured sheet of homogenised tobacco material may facilitate gathering of the sheet of homogenised tobacco material to form the tubular aerosol-forming substrate.

As used herein, the term 'sheet' refers to a laminar element having a width and length substantially greater than a thickness. As used herein, the term 'gathered' is used to describe a sheet that is convoluted, folded, or otherwise compressed or constricted substantially transversely to a longitudinal axis of the tubular aerosol-generating article. As used herein, the term 'textured sheet' denotes a sheet that has been crimped, embossed, debossed, perforated or otherwise deformed. As used herein, the term 'homogenised tobacco material' refers to a material formed by agglomerating particulate tobacco.

The tubular aerosol-forming substrate may comprises a gathered crimped sheet of homogenised tobacco material. As used herein, the term 'crimped sheet' refers to a sheet having a plurality of substantially parallel ridges or corrugations. Preferably, the substantially parallel ridges or corrugations extend along or parallel to a longitudinal axis of the tubular aerosol-generating article. This may facilitate gathering of the crimped sheet of homogenised tobacco material to form the tubular aerosol-generating article. However, it will be appreciated that crimped sheets of homogenised tobacco material for inclusion in the tubular aerosol-generating article may alternatively or in addition have a plurality of substantially parallel ridges or corrugations that are disposed at an acute or obtuse angle to the longitudinal axis of the tubular aerosol-generating article.

The tubular aerosol-forming substrate may comprise one or more aerosol formers. The tubular aerosol-forming substrate may comprise a single aerosol former. The tubular aerosol-forming substrate may comprise two or more aerosol formers. The tubular aerosol-forming substrate may have an aerosol former content of greater than about 5 percent on a dry weight basis. The aerosol aerosol-forming substrate may have an aerosol former content of between about 5 percent and approximately 30 percent on a dry weight basis. The tubular aerosol-forming substrate may have an aerosol former content of about 20 percent on a dry weight basis.

As used herein, the term 'aerosol former' refers to any suitable known compound or mixture of compounds that, in use, facilitates formation of an aerosol and that is substantially resistant to thermal degradation at the operating temperature of the tubular aerosol-generating article. Suitable aerosol-formers include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

The tubular aerosol-generating article may comprise one or more layers circumscribing the tubular aerosol-forming substrate. For example, the tubular aerosol-generating article may comprise one or more wrappers wrapped around the tubular aerosol-forming substrate.

The one or more layers may comprise a thermally insulating material. Wrapping a layer of thermally insulating material around the tubular aerosol-forming substrate may facilitate retention of heat from the one or more electric in the tubular aerosol-generating article. This may improve the conductive heat-transfer efficiency of the aerosol-generating system. As used herein the term 'thermally insulating material' is used to describe material having a bulk thermal conductivity of less than about 50 milliwatts per metre Kelvin (mW/(m·K)) at 23° C. and a relative humidity of 50% as measured using the modified transient plane source (MTPS) method. The thermally insulating material may also have a bulk thermal diffusivity of less than or equal to about 0.01 square centimetres per second (cm2/s) as measured using the laser flash method.

The one or more layers may comprise a material that is substantially impermeable to gases, such as air. Circumscribing the tubular aerosol-forming substrate with a layer of material that is substantially impermeable to gas may facilitate retention of vapour generated by the tubular aerosol-generating article in the aerosol-generating system and may facilitate direction of the vapour towards the user.

The one or more layers may comprise any suitable material. The one or more layers may comprise a paper-like material. The one or more layers may comprise cigarette paper. The one or more layers may comprise tipping paper.

The inner passage of the tubular aerosol-forming substrate may be the inner passage of the tubular aerosol-generating article. As such, the one or more electric heaters of the main unit may be adjacent to or in contact with the tubular aerosol-forming substrate when the tubular aerosol-generating article is received on the heating portion of the main unit. However, in some embodiments, the tubular aerosol-generating article may comprise one or more layers circumscribing the inner surface of the inner passage of the tubular aerosol-forming substrate. The one or more inner layers may comprise substantially the same material as described above in relation to the one or more outer layers.

At least one end of the inner passage of the tubular aerosol-generating article may be open and configured to receive the heating portion of the main unit. The inner passage of the tubular aerosol-generating article may comprises two open ends configured to receive the heating portion of the main unit.

The tubular aerosol-generating article may comprise additional components.

The tubular aerosol-generating article may comprise a mouthpiece. The mouthpiece may be arranged at the proximal end of the tubular aerosol-generating article. Where the tubular aerosol-generating article comprises a mouthpiece, the tubular aerosol-generating article may comprise a proximal end comprising the mouthpiece and a distal end comprising an open end of the inner passage configured to receive the heating portion of the main unit.

The mouthpiece may be a single segment or component mouthpiece. The mouthpiece may be a multi-segment or multi-component mouthpiece. The mouthpiece may comprise a material of low or very low filtration efficiency. The mouthpiece may comprise a filter comprising one or more segments comprising any suitable filtration materials. Suitable filtration materials are known in the art and include, but are not limited to, cellulose acetate and paper. The mouthpiece may comprise one or more segments comprising absorbents, adsorbents, flavourants, and other aerosol modifiers and additives or combinations thereof. The mouthpiece may have a width that is substantially equal to the width of the tubular aerosol-generating article.

Where the tubular aerosol-generating article comprises a mouthpiece, the tubular aerosol-generating article may be configured such that the main unit terminates inside the tubular aerosol-generating article. The proximal end of the main unit may abut or contact the mouthpiece when the tubular aerosol-generating article is received on the heating portion of the main unit. The proximal end of the main unit may be spaced from the mouthpiece when the tubular aerosol-generating article is received on the heating portion of the main unit.

The tubular aerosol-generating article may comprise additional components, including at least one of an aerosol-cooling element and a transfer element arranged between the tubular aerosol-forming substrate and the mouthpiece.

The tubular aerosol-generating article may comprise a cooling element arranged between the tubular aerosol-forming substrate and the mouthpiece. The cooling element may comprise a plurality of longitudinally extending channels. The cooling element may comprise a gathered sheet of material selected from the group consisting of metallic foil, polymeric material, and substantially non-porous paper or cardboard.

The tubular aerosol-generating article may comprise a transfer element or spacer element arranged between the tubular aerosol-forming substrate and the mouthpiece. The transfer element may facilitate cooling of the aerosol generated by the heated the tubular aerosol-forming substrate. The transfer element may also facilitate adjustment of the length of the aerosol-generating system to a desired value, for example to a length similar to that of a conventional cigarette. The transfer element may comprise at least one open-ended tubular hollow body formed from one or more suitable materials that are substantially thermally stable at the temperature of the aerosol generated by the transfer of heat from the combustible heat source to the aerosol-forming substrate. Suitable materials are known in the art and include, but are not limited to, paper, cardboard, plastics, such a cellulose acetate, ceramics and combinations thereof.

Where the tubular aerosol-generating article comprises one or more layers or wrappers circumscribing the tubular aerosol-forming substrate, the one or more layers or wrappers may also circumscribe any of the additional components, such as the mouthpiece, the cooling element and the transfer element.

According to a second aspect of the present invention, there is provided a tubular aerosol-generating article for an electrically operated aerosol-generating system according to the first aspect of the present invention. The tubular aerosol-generating article comprises: a tubular aerosol-forming substrate; and an inner passage configured to receive a heating portion of a main unit of an electrically operated aerosol-generating system. The tubular aerosol-generating article further comprises at least one retaining feature configured to removably retain the tubular aerosol-generating article on the heating portion of the main unit when the tubular aerosol-generating article is received on the heating portion.

The aerosol-generating system of the present invention also comprises a main unit. The main unit may comprise a housing. The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. The material may be light and non-brittle. The main unit may comprise a proximal portion and a distal portion. The proximal portion and the distal portion of the main unit may have different shapes and dimensions.

The proximal portion of the main unit may comprise the heating portion. As used herein, the term 'heating portion' is used to describe the portion of the main unit that comprises the one or more electric heaters. The extent of the heating portion is determined by the extent of the heaters along the length of the main unit.

The heating portion may have any suitable shape and dimensions. The shape and dimensions of the heating portion may be substantially similar to the shape and dimensions of the inner passage of the tubular aerosol-generating article. The shape and dimensions of the heating portion may be complementary to the shape of the inner passage of the tubular aerosol-generating article.

The heating portion may be substantially cylindrical. The heating portion may be substantially elongate. The heating portion may have any suitable cross-section. For example, the cross-section of the heating portion may be substantially circular, elliptical, square or rectangular. The shape of the heating portion may be substantially similar to the shape of the inner passage of the tubular aerosol-generating article. The shape of the heating portion may be complementary to the shape of the inner passage of the tubular aerosol-generating article.

Where the cross-sections of the heating portion and the tubular aerosol-generating article are not circularly symmetrical, the tubular aerosol-generating article may be received on the heating portion at specific rotational orientations. Where the cross-sections of the heating portion and the tubular aerosol-generating article are circularly symmetrical, this may eliminate the need to maintain a specific rotational orientation of the tubular aerosol-generating article for the tubular aerosol-generating article to be received by the heating portion.

The heating portion may have a width of between about 2 mm and about 18 mm, between about 2 mm and about 10 mm or about 4 mm. The heating portion may have a length of between about 10 mm and about 100 mm, or between about 10 mm and about 50 mm or about 45 mm.

The main unit may comprise any suitable number of electric heaters. The main unit may comprise one electric heater. The main unit may comprise two or more electric heaters. The main unit may comprise two, three, four, five, six, seven eight or nine electric heaters. Where the main unit comprises two or more electric heaters, the two or more electric heaters may be spaced around the circumference of the heating portion. The two or more electric heaters may be spaced along the length of the heating portion. Where the heating portion comprises three or more electric heaters, the three or more electric heaters may be spaced evenly across the heating portion. The three or more electric heaters may be spaced unevenly across the heating portion.

The one or more electric heaters may be any suitable shape. The one or more electric heaters may be elongate. The one or more electric heaters may extend substantially the length of the heating portion. The one or more electric heaters may be substantially annular. The one or more electric heaters may comprise one or more annular rings. The one or more rings may substantially circumscribe a portion of the outer surface of the main unit. The one or more rings may substantially circumscribe a portion of the proximal end of the heating portion. The one or more rings may substantially circumscribe a portion of the distal end of the heating portion.

The one or more electric heaters may comprise an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel, Timetal® and iron-manganese-aluminium based alloys. In composite materials, the electrically resistive material may optionally be embedded in, encapsulated or coated with an insulating material or vice-versa, depending on the kinetics of energy transfer and the external physicochemical properties required. Examples of suitable composite heater elements are disclosed in U.S. Pat. No. 5,498,855, WO-A-03/095688 and U.S. Pat. No. 5,514,630.

The distal portion of the main unit may be any suitable shape and dimensions.

The distal portion may be substantially cylindrical. The distal portion may be substantially elongate. The distal portion may have any suitable cross-section. For example, the cross-section of the distal portion may be substantially circular, elliptical, square or rectangular. The distal portion may be configured to be held by a user during use of the aerosol-generating system.

The width of the distal portion of the main unit may be larger than the width of the proximal portion of the main unit. This may provide a larger space in the distal portion than in the proximal portion and may enable the distal portion to accommodate a power supply and electric circuitry.

The width of the distal portion of the main unit may be similar to the width of the tubular aerosol-generating article. As such, when the tubular aerosol-generating article is received on the heating portion of the main unit, the aerosol-generating system may form a substantially cylindrical unit having a substantially consistent width along its length. This may enable the aerosol-generating system to resemble a conventional smoking article, such as a cigar or a cigarette.

The distal portion may have a width of between about 5 mm and about 20 mm, between about 5 mm and about 12 mm or about 8 mm. The distal portion may have a length of between about 10 mm and about 100 mm, or between about 10 mm and about 50 mm or about 45 mm.

The main unit may comprise a shoulder between the heating portion and the distal portion of the main unit. The shoulder may connect the outer surface of the proximal portion of the main unit to the outer surface of the distal portion of the main unit. The shoulder may comprise an angled, sloped or bevelled surface joining the proximal portion of the main unit and the distal portion of the main unit. The shoulder may comprise a wall extending substantially radially outwards from the outer surface of the proximal portion of the main unit to the outer surface of the distal portion of the main unit.

The proximal portion of the main unit may be configured such that the distal end of the tubular aerosol-generating article may abut or contact the shoulder when the tubular aerosol-generating article is received on the heating portion. As such, the shoulder may act as a stop to inhibit movement of the tubular aerosol-generating article beyond the heating portion in a distal direction relative to the main unit. This may facilitate positioning of the tubular aerosol-generating article on the heating portion of the main unit in the desired position along the length of the main unit.

The main unit may further comprise a distal stop. The distal stop may be arranged distal to the heating portion of the main unit. The distal stop may be configured to engage with the distal end of the tubular aerosol-generating article when the tubular aerosol-generating article is received on the heating portion. Where the main unit comprises a shoulder between the proximal portion and the distal portion, there distal stop may be arranged between the heating portion and the shoulder.

The main unit may comprise one or more electric power supplies. The one or more electric power supplies may be arranged in the distal portion of the main unit. The one or more power supplies may comprise a battery. The battery may be a Lithium based battery, for example a Lithium-Cobalt, a Lithium-Iron-Phosphate, a Lithium Titanate or a Lithium-Polymer battery. The battery may be a Nickel-metal hydride battery or a Nickel cadmium battery. The one or more power supplies may comprise other forms of charge storage devices, such as capacitors. The one or more power supplies may require recharging and may be configured for many cycles of charge and discharge. The one or more power supplies may have a capacity that allows for the storage of enough energy for one or more user experiences; for example, the one or more power supplies may have sufficient capacity to allow for the continuous generation of aerosol for a period of around six minutes, corresponding to the typical time taken to smoke a conventional cigarette, or for a period that is a multiple of six minutes. In another example, the one or more power supplies may have sufficient capacity to allow for a predetermined number of puffs or discrete activations of the heating means and actuator.

The main unit may comprise electric circuitry configured to control the supply of power to the one or more electric heaters from the one or more electrical power supplies. Where the main unit comprises two or more electric heaters, the electric circuitry may be configured to supply power to all of the electric heaters simultaneously. Where the main unit comprises two or more electric heaters, the electric circuitry may be configured to supply power to each electric heater separately. The electric circuitry may be configured to supply power to each electric heater selectively. The electric circuitry may be configured to supply power to the electric heaters sequentially. The electric circuitry may be configured to supply power to selected ones of the electric heaters in a predetermined sequence. For example, the electric circuitry may be configured to supply power to one heater per puff. In another example, the electric circuitry may be configured to supply power to a first heater for a predetermined period of time and subsequently to supply power to a second heater for a predetermined period of time. This may enable selective heating of portions of the aerosol-forming substrate. This may enable variation of the aerosol supplied to the user during a puff. This may enable portions of the aerosol-forming substrate to be heated to different temperatures. This may enable the aerosol-generating system to preserve unheated portions of aerosol-forming substrate for each puff of a user experience.

The main may comprise a user input, such as a switch or button. This may enable the user to switch the main unit on and off. The switch or button may activate the aerosol-generating means. The switch or button may initiate aerosol generation. The switch or button may prepare the electric circuitry to await input from the puff detector.

The electric circuitry may comprise a sensor or a puff detector to detect air flow through the aerosol-generating system indicative of a user taking a puff. The electric circuitry may be configured to provide supply power to the one or more electric heaters when the sensor senses a user taking a puff.

The main unit may comprise a mouthpiece. The mouthpiece may be arranged at the proximal end of the main unit. The mouthpiece may be configured to allow a user to suck, puff or draw on the mouthpiece to draw air and vapour through one or more airflow pathways of the aerosol-generating system.

The mouthpiece may comprise at least one retaining feature in accordance with the present invention. For example, the mouthpiece may comprise one or more of the one or more protrusions. In another example, the mouthpiece may comprise the second magnetic material.

The mouthpiece may be removably receivable on the main unit. Where the mouthpiece is removable from the main unit, the mouthpiece may comprise a cover arranged to overlap the tubular aerosol-generating article when the tubular aerosol-generating article is received on the heating portion of the main unit. The cover may further facilitate retention of heat around the tubular aerosol-generating article and may inhibit the exit of vapour from the tubular aerosol-generating article through the outer surface of the tubular aerosol-generating article.

According to a third aspect of the present invention, there is provided a main unit for an electrically operated aerosol-generating system according to the first aspect of the present invention. The main unit comprises a heating portion arranged at an outer surface of the main unit. The heating portion comprises one or more electric heaters. The main unit further comprises at least one retaining feature configured to removably retain a tubular aerosol-generating article on the heating portion of the main unit when the tubular aerosol-generating article is received on the heating portion of the main unit.

When the electrically operated aerosol-generating system is assembled for use and the tubular aerosol-generating article is received on the heating portion of the main unit, the aerosol-generating system may have a substantially cylindrical shape. The aerosol-generating system may have a total length of between about 70 mm and about 200 mm, or between about 70 mm and about 150 mm, or about 120 mm. The aerosol-generating system may have a width of between about 5 mm and about 20 mm, between about 5 mm and about 10 mm or about 8 mm.

The main unit may be configured to be durable. The main unit may be configured to be reusable.

The tubular aerosol-generating article may be configured to be a disposable component. The tubular aerosol-generating article may be configured to be disposed after a single user experience. In contrast, the main unit may be configured to be durable and reusable. The main unit may comprise relatively expensive and durable components of the aerosol-generating system, such as a power supply, heaters, and electrical circuitry.

The tubular aerosol-generating article may be manufactured, stored and sold separately from the main unit. Each tubular aerosol-generating article may be individually packaged. A plurality of the tubular aerosol-generating articles may be packaged and sold together, similarly to conventional smoking articles such as cigarettes.

Embodiments in accordance with the present invention will now be described in detail, by way of example only, with reference to the accompanying drawings, in which.

Figure 13:
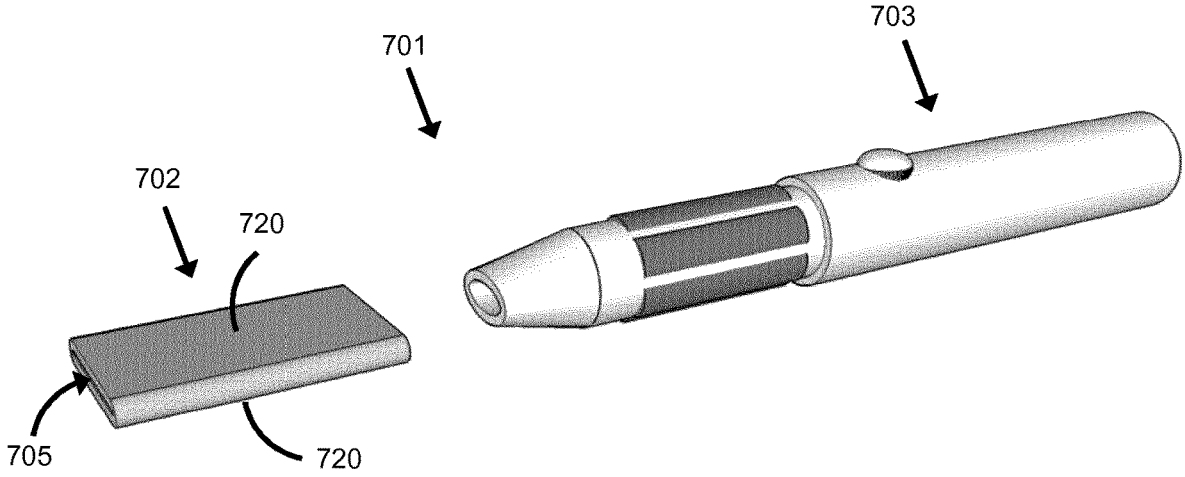
FIG. 13 is a schematic illustration of an electrically operated aerosol-generating system according to another embodiment of the present invention.
Figure 15:
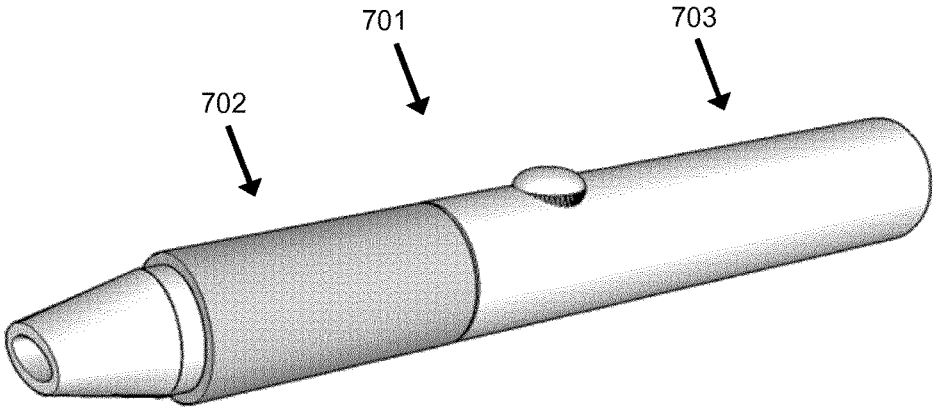
Figure 16:
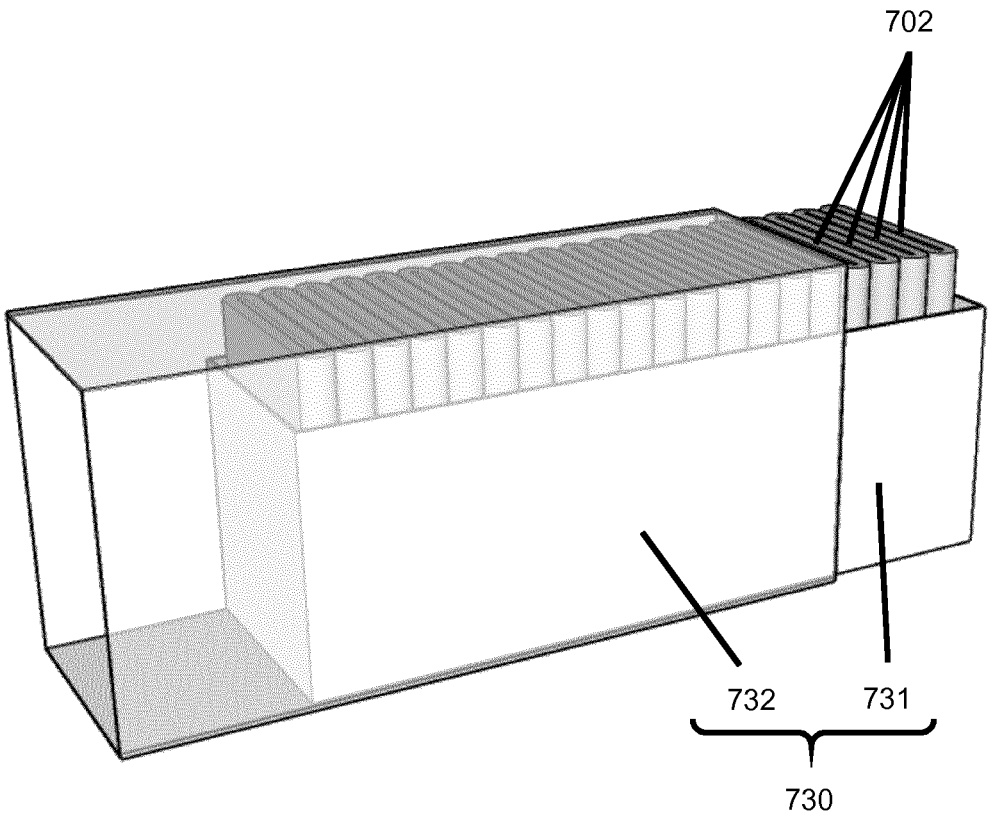

FIG. 15 is a schematic illustration of the electrically operated aerosol-generating system of FIG. 13, showing the tubular aerosol-generating article fully received on the main unit; and FIG. 16 is a schematic illustration of a plurality of tubular aerosol-generating articles of the electrically operated aerosol-generating system of FIG. 13, showing the tubular aerosol-generating articles packaged together in a storage configuration.

Figure 1:
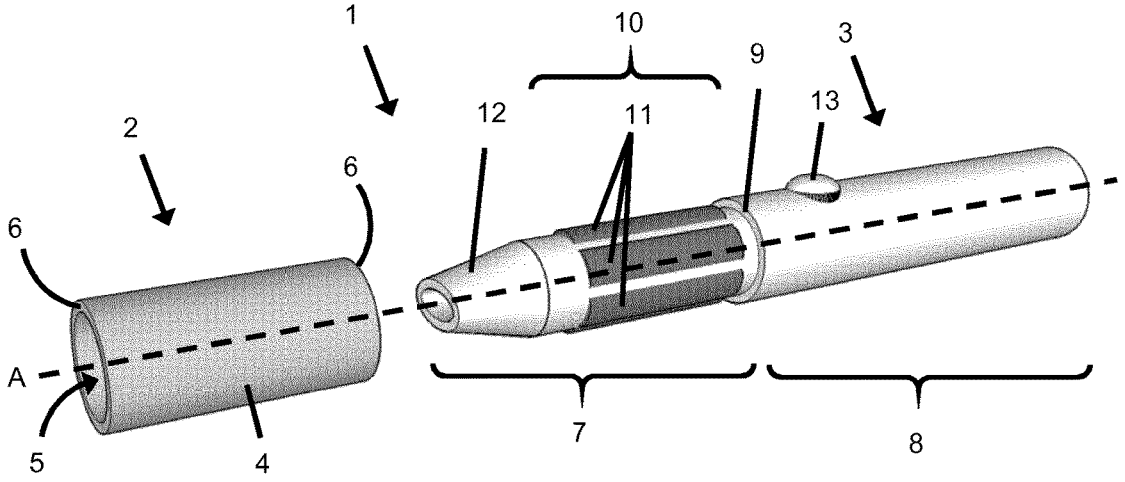
FIG. 1 is a schematic illustration of an electrically operated aerosol-generating system comprising a main unit and a tubular aerosol-generating article.
Figure 2:
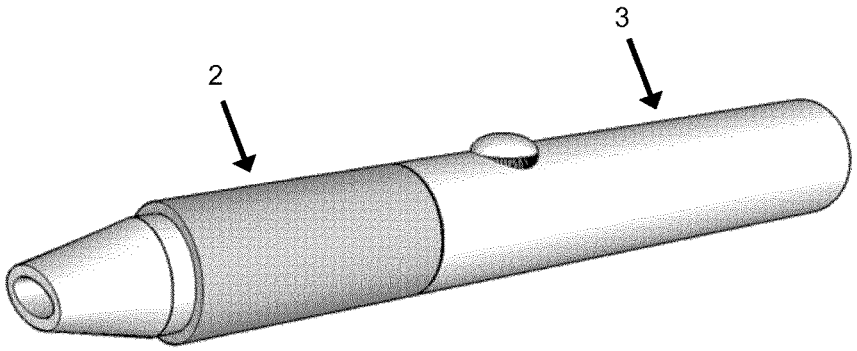
FIG. 2 is a schematic illustration of the electrically operated aerosol-generating system of FIG. 1, showing the tubular aerosol-generating article fully received on the main unit.
Figure 3:
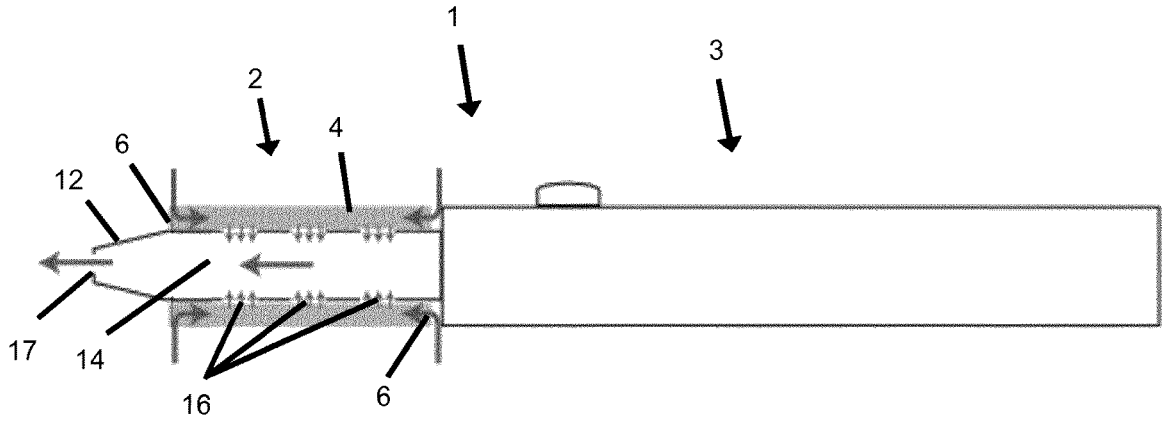
FIG. 3 is a schematic illustration of the electrically operated aerosol-generating system of FIG. 1 showing airflow through the aerosol-generating system when the aerosol-generating article is fully received on the main unit and a user is drawing on the mouthpiece.

An exemplary electrically operated aerosol-generating system having a tubular aerosol-generating article is shown in FIGS. 1 to 3. The electrically operated aerosol-generating system 1 comprises a tubular aerosol-generating article 2 and a main unit 3.

The tubular aerosol-generating article 2 comprises a cylindrical open-ended hollow tube of aerosol-forming substrate 4. An inner passage 5 extends centrally through the tubular aerosol-forming substrate 4 and extends the length of the tubular aerosol-forming substrate 4 such that both ends of the inner passage 5 are open. Both open ends of the inner passage 5 are configured to receive a proximal portion 7 of the main unit 3.

The tubular body of aerosol-forming substrate 4 comprises one or more gathered sheets of tobacco circumscribed by an outer wrapper (not shown), which covers the cylindrical outer surface of the tubular body of aerosol-forming substrate 4. The outer wrapper is formed of a material that is substantially impermeable to gas, such that the outer wrapper substantially prevents ambient air from being drawn into the tubular aerosol-generating article 2 through the cylindrical outer surface. The outer wrapper also substantially prevent vapour from the heated aerosol-forming substrate 4 from leaving the tubular aerosol-generating article 2 via the cylindrical outer surface.

The outer wrapper does not extend over the annular end faces 6 of the tubular aerosol-forming substrate 4, such that the annular end faces 6 of the tubular aerosol-forming substrate 4 are exposed to ambient air. Ambient air may be drawn into the tubular aerosol-generating article 2 through either annular end face 6. Similarly, the open ends of the inner passage 5 are not covered by the outer wrapper, such that the proximal portion 7 of the main unit 3 may be inserted into either end of the inner passage 5.

The main unit 3 comprises a substantially circularly-cylindrical hollow housing formed of a rigid, thermally insulating material, such as PEEK. The main unit 3 comprises a proximal portion 7 and a distal portion 8 that are separated by a shoulder 9.

The proximal portion 7 comprises a heating portion 10 having seven identical electrical heaters 11. The seven electric heaters 11 are spaced evenly around the circumference of the heating portion 10. Each of the electrical heaters 11 is elongate and arranged with its length extending in the direction along a longitudinal axis A of the main unit 3. The length of each electric heater 11 is substantially similar to the length of the tubular aerosol-generating article 2. As such, when the tubular aerosol-generating article 2 is received on the heating portion 10 of the main unit 3, the tubular aerosol-generating article 2 overlaps and covers the electrical heaters 11 along their entire length. This enables a substantial proportion of the heat produced by the heaters 11 to be transferred to the aerosol-forming-substrate 4 rather than to ambient air during use of the aerosol-generating system.

The heating portion 10 of the main unit 3 has a circularly-cylindrical cross-section that is substantially similar to the cross-section of the inner passage 5 of the tubular aerosol-generating article 2. The width of the heating portion 10 is slightly larger than the width of the inner passage 5. As such, the heating portion 10 of the main unit 3 may be inserted into the inner passage 5 of the tubular aerosol-generating article with an interference or a friction fit. The interference or friction fit ensures contact between the electric heaters 11 at the outer surface of the heating portion 10 of the main unit 3 and the inner surface of the inner passage 5 of the tubular aerosol-generating article 2, when the tubular aerosol-generating article 2 is received on the heating portion 10. This contact facilitates heat transfer between the heaters 11 and the tubular aerosol-forming substrate 4. The interference of friction fit also provides some resistance against movement of the tubular aerosol-generating article 2 along the longitudinal axis A of the main unit 3. As such, the interference or friction fit helps to retain the tubular aerosol-generating article 2 on the heating portion 10 of the main unit 3.

The proximal portion 7 of the main unit 3 further comprises a tapered mouthpiece 12 at the proximal end of the main unit 3 for a user to draw upon to receive aerosol generated by the aerosol-generating system.

The distal portion 8 of the main unit 3 has a cylindrical cross-section that is substantially similar to the cylindrical cross-section of the tubular aerosol-generating article 2. The width of the distal portion 8 is substantially similar to the width of the tubular aerosol-generating article 2. As such, when the tubular aerosol-generating article 2 is received on the heating portion 10 of the main unit 3, the electrically operated aerosol-generating system 1 forms a substantially circularly-cylindrical unit having a consistent width or diameter that may resemble a conventional cigarette or cigar, as shown in FIG. 2.

The distal portion 8 of the main unit 2 houses a battery (not shown) and electric circuitry (not shown) inside the hollow housing. The battery is arranged and configured to supply power to the electric heaters 11 of the heating portion 10. The electric circuitry is configured to control the supply of power from the battery to the electric heaters 11. The electric circuitry comprises a sensor for detecting a user's puff on the mouthpiece 12.

The electric circuitry is configured to supply power to the electric heaters 11 either simultaneously or individually in a predetermined sequence. In other words, the electric circuitry is configured to supply power to the electric heaters 11 in different heating modes, such as a simultaneous heating mode and a sequential heating mode. For example, in a simultaneous heating mode, the electric circuitry is configured to supply power to all of the heaters 11 when a puff is detected. In another example, in a sequential mode, the electric circuitry is configured to supply electrical power to a first one of the heaters 11 when a first puff is detected, to supply electrical power a second one of the heaters 11 when a second puff is detected and to subsequently supply power to individual ones of the remaining heaters 11, in sequence, for each detected puff until all of the heaters have been activated.

A push button 13 is also provided on the distal portion 8 of the main unit 3. The electric circuitry is configured to switch between heating modes on depression of the push button 13. Consecutive depressions of the push button 13 switch the heating mode of the electric circuitry between a sequential heating mode, a simultaneous heating mode and a no power mode (off).

The width of the distal portion 8 of the main unit 3 is larger than the width of the proximal portion 7. As such, the main unit 3 comprises a shoulder 9 separating the proximal portion 7 from the distal portion 8. The shoulder 9 comprises a wall extending substantially radially outwardly from the distal end of the proximal portion 7 to the proximal end of the distal portion 8.

A distal stop (not shown) is arranged on the proximal portion 7 of the main unit 3, between the heating portion 10 and the shoulder 9. The distal stop is configured to engage with the distal end of the tubular aerosol-generating article 2 when the tubular aerosol-generating article 2 is fully received on the heating portion 10. The distal stop substantially prevents movement of the tubular aerosol-generating article 2 beyond the heating portion 10 in a distal direction towards the distal portion 8.

It will be appreciated that in some embodiments, the shoulder 9 may act as the distal stop for the tubular aerosol-generating article 2. In these embodiments, the shoulder 9 may abut or contact the distal end of the tubular aerosol-generating article 2 when the tubular aerosol-generating article 2 is fully received on the heating portion 10.

As shown in FIG. 3, an air passage 14 extends through the proximal portion 7 of the main unit 3. A plurality of air inlets 16 are arranged in the outer face of the heating portion 10, between the electric heaters 11, and an air outlet 17 is provided in the mouthpiece 12. The plurality of air inlets 16 and the air outlet 17 are fluidly connected to the air passage 14 to enable air to be drawn through the air passage 14 when a user draws on the mouthpiece 12.

To assemble the electrically operated aerosol-generating system 1 for use, a user aligns main unit 3 and the inner passage of the tubular aerosol-generating article 2 along a common longitudinal axis A, with either end of the tubular aerosol-generating article 2 facing the proximal end of the main unit 3. The user moves the tubular aerosol-generating article 2 along the common axis A towards the main unit 3, such that the proximal end of the main unit 3 is inserted into the distal open end of the inner passage 5. The user slides the tubular aerosol-generating article 2 over the proximal portion 7 of the main unit 3, towards the distal portion 8, until the distal end of the tubular aerosol-generating article 2 abuts the distal stop (not shown). In this position, the tubular aerosol-generating article 2 is fully received on the heating portion 10 of the main unit 3, and the tubular aerosol-generating article 2 covers the electric heaters 11 and the air inlets 16, as shown in FIGS. 2 and 3.

In use, the user depresses the push button 13 to switch the main unit 3 from the off mode into the sequential heating mode. The user draws on the mouthpiece 12 of the main unit 3, and the electric circuitry (not shown) detects the user's puff on the mouthpiece 12. On detection of the user's puff, the electric circuitry supplies power from the power supply (not shown) to one of the electric heaters 11. The powered electric heater 11 heats a portion of the tubular aerosol-forming substrate 4 of the tubular aerosol-generating article 2. As the portion of the aerosol-forming substrate 4 is heated, volatile compounds of the aerosol-forming substrate vapourise and generating a vapour.

When the user draws on the mouthpiece 12 of the main unit 3, ambient air is drawn into the tubular aerosol-generating article 2 through the annular end faces 6 of the tubular aerosol-forming substrate 4. The air drawn into the tubular aerosol-generating article 2 is drawn through the tubular aerosol-forming substrate 4 towards the air inlets 16 of the main unit 3. The vapour generated by the heated aerosol-forming substrate is entrained in the air is drawn through the aerosol-forming substrate 4. The entrained vapour is drawn out of the tubular aerosol-forming substrate 4 at the inner face of the inner passage 5 and enters the air passage 14 of the main unit 3 through the air inlets 16. The entrained vapour is drawn through the air passage 14 in a proximal direction towards the mouthpiece 12. As the vapour is drawn through the air passage 14, the vapour cools and forms an aerosol. The aerosol is drawn out of the air passage 14 through the air outlet 17 in the mouthpiece 12, and is delivered to the user for inhalation. The direction of airflow through the system 1 is indicated by the arrows shown in FIG. 3.

It will be appreciated that in some examples the tubular aerosol-generating article may comprise one or more air inlets at the cylindrical outer face, in the form of one or more perforations in the outer layers or wrappers circumscribing the tubular aerosol-forming substrate. In these embodiments, air may be drawn into the tubular aerosol-generating article through the perforations in the cylindrical outer face. The main unit may also comprise additional air inlets arranged distal or proximal to the heating portion. These additional air inlets may not be covered by the tubular aerosol-generating article when the tubular aerosol-generating article is fully received on the heating portion of the main unit. As such, these additional air inlets may enable ambient air to be drawn directly into the air passage of the main unit and may help to cool the vapour and aerosol before inhalation by the user. This may improve the experience for the user.

Figure 4:
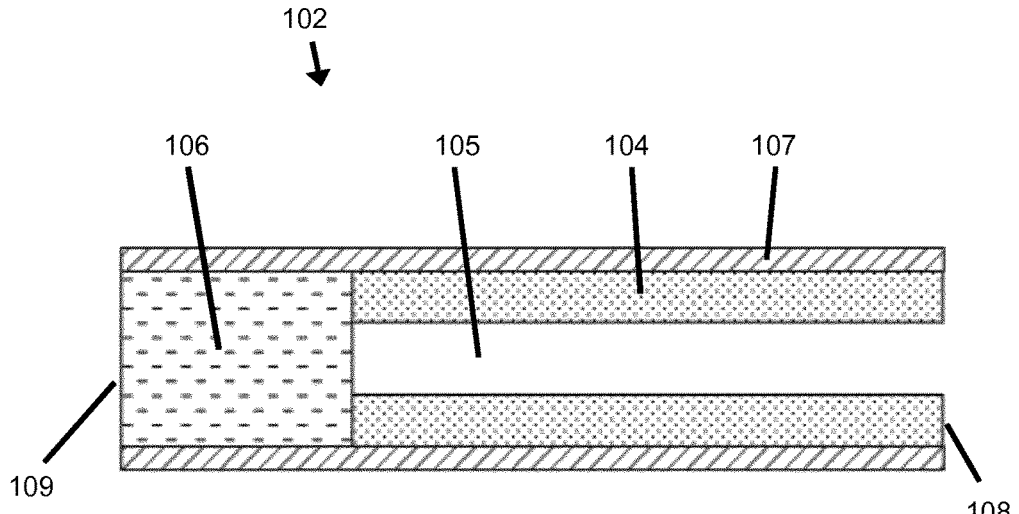
FIG. 4 is a schematic illustration of another example of a tubular aerosol-generating article.
Figure 5:
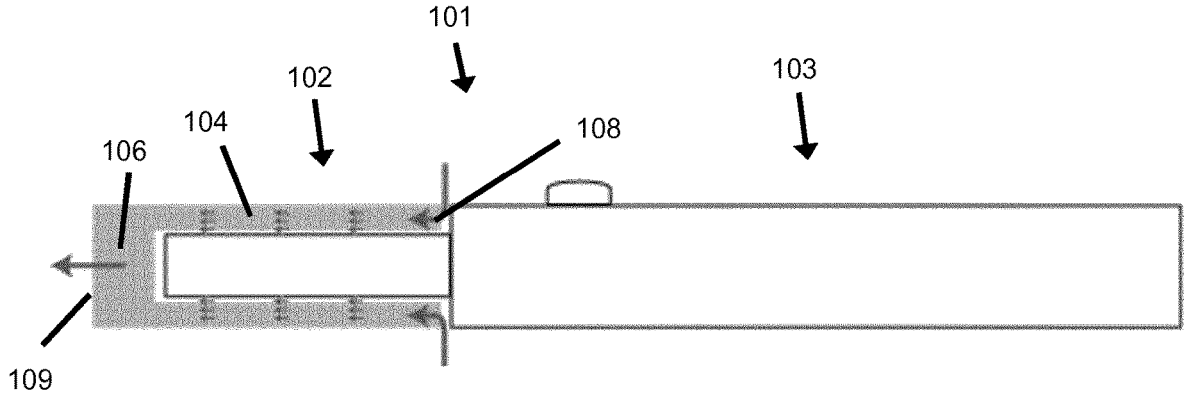
FIG. 5 is a schematic illustration of the tubular aerosol-generating article of FIG. 4 showing airflow through the tubular aerosol-generating article when the tubular aerosol-generating article is fully received on a main unit and a user is drawing on the mouthpiece.

Another example of an electrically operated aerosol-generating system having a tubular aerosol-generating article is shown in FIGS. 4 and 5. The electrically operated aerosol-generating system 101 shown in FIGS. 4 and 5 comprises a tubular aerosol-generating article 102 and a main unit 103.

The tubular aerosol-generating article 102 comprises a cylindrical open-ended hollow tube of aerosol-forming substrate 104. An inner passage 105 extends centrally through the tubular aerosol-forming substrate 104 and extends the length of the tubular aerosol-forming substrate 104 such that both ends of the inner passage 105 are open.

The tubular aerosol-generating article 102 further comprises a mouthpiece 106. The mouthpiece 106 comprises a circularly-cylindrical body of cellulose acetate, having a substantially similar circular cross-section and width to the tubular aerosol-forming substrate 104. The tubular aerosol-forming substrate 104 and the mouthpiece 106 are arranged in abutting coaxial alignment, such that the tubular aerosol-forming substrate 104 and mouthpiece 106 are configured to form a rod. The proximal end of the tubular aerosol-forming substrate 104 abuts the distal end of a mouthpiece 106.

The tubular aerosol-forming substrate 104 and the mouthpiece 106 are circumscribed by an outer wrapper 107. The outer wrapper 107 secures the tubular aerosol-forming substrate 104 to the mouthpiece 106. The outer wrapper 107 is formed of a material that is substantially impermeable to gas, such that the outer wrapper 107 substantially prevents ambient air from being drawn into the tubular aerosol-generating article 102 through the cylindrical outer surface. The outer wrapper 107 covers the cylindrical outer surfaces of the tubular aerosol-forming substrate 104 and the mouthpiece 106, but does not extend over the end faces, such that air may be drawn through the tubular aerosol-generating article 102, from the distal end face 108 to the proximal end face 109.

The distal end of the inner passage 105 is open and is configured to receive a proximal portion of the main unit 103. The proximal end of the inner passage 105 is arranged at the distal end of the mouthpiece 106.

It will be appreciated that the tubular aerosol-generating article 102 may further comprise additional components between the tubular aerosol-forming substrate and the mouthpiece 106.

The main unit 103 is substantially similar to the main unit 3 described above in relation to the example shown in FIGS. 1 to 3. However, the main unit 103 does not comprise an air passage though the proximal portion. As a result, the main unit 103 does not form part of the airflow pathways through the aerosol-generating system 101. In other words, the main unit 103 is substantially isolated from the air drawn through the aerosol-generating system 101.

In addition, the main unit 103 does not comprise a mouthpiece. The heaters (not shown) of the main unit 103 extend to the proximal end of the main unit 103, such that the proximal end of the main unit is the proximal end of the heating portion.

Since the main unit is substantially isolated from the air drawn through the aerosol-generating system 101, the electric circuitry does not comprise a sensor for detecting a user's puff. In this example, the electric circuitry determines when power is to be supplied to the electric heaters by activation of the push button by the user.

The main unit 103 comprises a distal stop (not shown) arranged between the distal end of the heating portion and the shoulder of the main unit 103. However, it will be appreciated that the distal stop may not be required as the proximal end of the main unit may abut the distal end of the mouthpiece 106 when the tubular aerosol-generating article 102 is fully received on the heating portion.

To assemble the electrically operated aerosol-generating system 101 for use, a user aligns the main unit 103 and the inner passage 105 of the tubular aerosol-generating article 102 along a common longitudinal axis, with the distal end 108 of the tubular aerosol-generating article 102 facing the proximal end of the main unit 103. The user moves the tubular aerosol-generating article 102 along the common axis towards the main unit 103, such that the proximal end of the main unit 103 is inserted into the open distal end of the inner passage 105. The user slides the tubular aerosol-generating article 102 over the proximal portion of the main unit 103, in a distal direction towards the distal portion, until the distal end 108 of the tubular aerosol-generating article 102 abuts the distal stop and the proximal end of the main unit 103 abuts the distal end of the mouthpiece 106. In this position, the tubular aerosol-generating article 102 is fully received on the heating portion of the main unit 103, and the tubular aerosol-generating article 102 covers the electric heaters, as shown in FIG. 5.

In use, the user depresses the push button to switch the main unit 103 from the off mode into the sequential heating mode and the electric circuitry supplies power from the power supply (not shown) to one of the electric heaters. The powered electric heater heats a portion of the tubular aerosol-forming substrate 104 of the tubular aerosol-generating article 102. As the portion of the aerosol-forming substrate 104 is heated, volatile compounds of the aerosol-forming substrate vapourise generating a vapour.

When the user draws on the mouthpiece 106 of the tubular aerosol-generating article 102, ambient air is drawn into the tubular aerosol-generating article 102 through the distal end face 108 of the tubular aerosol-forming substrate 104. The air drawn into the tubular aerosol-generating article 102 is drawn through the tubular aerosol-forming substrate 104 in a proximal direction towards the mouthpiece 106. The vapour generated by the heated aerosol-forming substrate 104 is entrained in the air being drawn through the aerosol-forming substrate 104. The entrained vapour is drawn out of the tubular aerosol-forming substrate 104 at the proximal end, and enters the mouthpiece 106. The entrained vapour is drawn through the mouthpiece 106 towards the proximal end 109. As the vapour is drawn through the mouthpiece 106, the vapour cools and forms an aerosol. The aerosol is drawn out of the mouthpiece 106 at the proximal end 109, and is delivered to the user for inhalation. The direction of airflow through the system 101 is indicated by the arrows shown in FIG. 5.

It will be appreciated that tubular aerosol-generating articles comprising a mouthpiece, such as the tubular aerosol-generating article 102, may also be used with main units comprising air passages, such as the main unit 3 described above in relation to the example shown in FIGS. 1 to 3. In such systems, the main unit may not comprise a mouthpiece, but rather may comprise an air outlet that is in fluid communication with the mouthpiece of the tubular aerosol-generating article when the tubular aerosol-generating article is fully received on the heating portion of the main unit.

Electrically operated aerosol-generating systems according to several embodiments of the present invention are shown in FIGS. 6 to 16.

Figure 6:
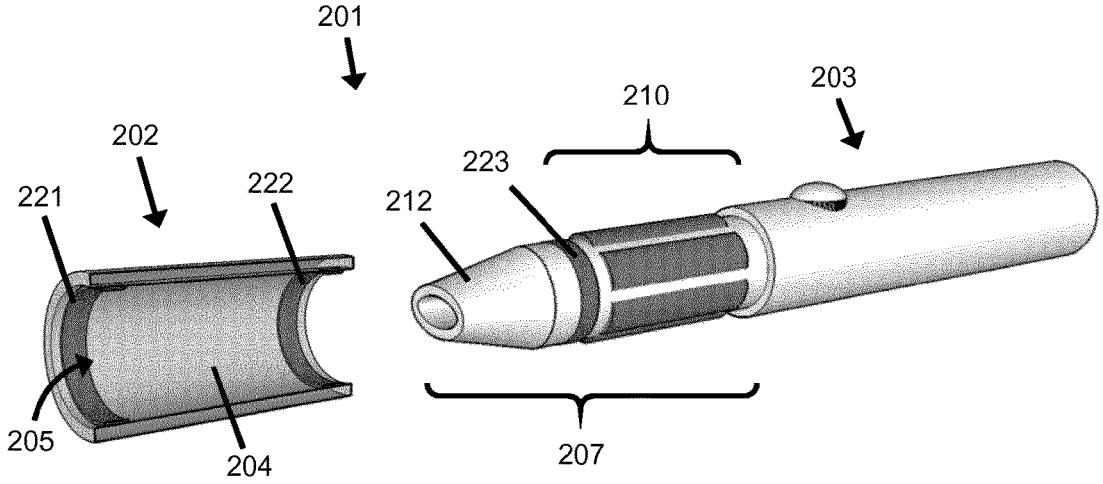
FIG. 6 is a schematic illustration of an electrically operated aerosol-generating system according to an embodiment of the present invention.

FIG. 6 shows an electrically operated aerosol-generating system 201 according to a first embodiment of the present invention. The electrically operated aerosol-generating system 201 comprises a tubular aerosol-generating article 202 and a main unit 203. The tubular aerosol-generating article 202 and the main unit 203 are substantially similar to the tubular aerosol-generating article 2 and the main unit 3 described above in relation to FIGS. 1 to 3, and where the same features are present like reference numerals have been used to refer to these features.

The tubular aerosol-generating article 202 comprises two magnetic rings 221, 222 circumscribing a portion of the inner surface of the inner passage 205. The first ring 221 is arranged at one end of the inner passage 205, and the second ring 222 is arranged at the opposite end of the inner passage 205. Both the first and second magnetic rings 221, 222 are comprised of a first magnetic material, such as cobalt ferrite.

The main unit 203 comprises a third magnetic ring 223 circumscribing a portion of the outer surface of the proximal portion 207. The third ring 223 is comprised of a second magnetic material. The second magnetic material may comprise the same magnetic material as the first magnetic material. The second magnetic material is configured and arranged to magnetically attract the first magnetic material when the first magnetic material is arranged at the outer surface of the proximal portion 207 of the main unit 203.

The third ring 223 is arranged between the heating portion 210 and the mouthpiece 212, such that the proximal end of the tubular aerosol-generating article 202 overlaps the third ring 223 when the tubular aerosol-generating article 202 is fully received on the heating portion 210.

To assemble the electrically operated aerosol-generating system 201 for use, the proximal portion 207 of the main unit 203 may be inserted into either open end of the tubular aerosol-generating article 202. If the proximal portion 207 is inserted into the open end comprising the second ring 222 and moved through the inner passage 205 until the tubular aerosol-generating article 202 is fully received on the heating portion 210, the first magnetic ring 221 of the tubular aerosol-generating article 202 is arranged directly above the third ring 223 when the tubular aerosol-generating article is fully received on the heating portion 210. Similarly, if the proximal portion 207 is inserted into the open end comprising the first ring 221 and moved through the inner passage 205 until the tubular aerosol-generating article 202 is fully received on the heating portion 210, the second magnetic ring 222 of the tubular aerosol-generating article 202 is arranged directly above the third ring 223 when the tubular aerosol-generating article is fully received on the heating portion 210.

When the tubular aerosol-generating article 202 is fully received on the heating portion 210 of the main unit 203, the magnetic attraction between the first magnetic material and the second magnetic material applies a force on the tubular aerosol-generating article 202 radially inwards towards the heating portion 210. This force retains the tubular aerosol-generating article 202 on the heating portion 210 of the main unit 203. The magnetic attraction between the first magnetic material and the second magnetic material is such that the user is required to apply a moderate force to the tubular aerosol-generating article 202, in a proximal direction, to remove the tubular aerosol-generating article 202 from the heating portion 210 of the main unit 203.

Figure 7:
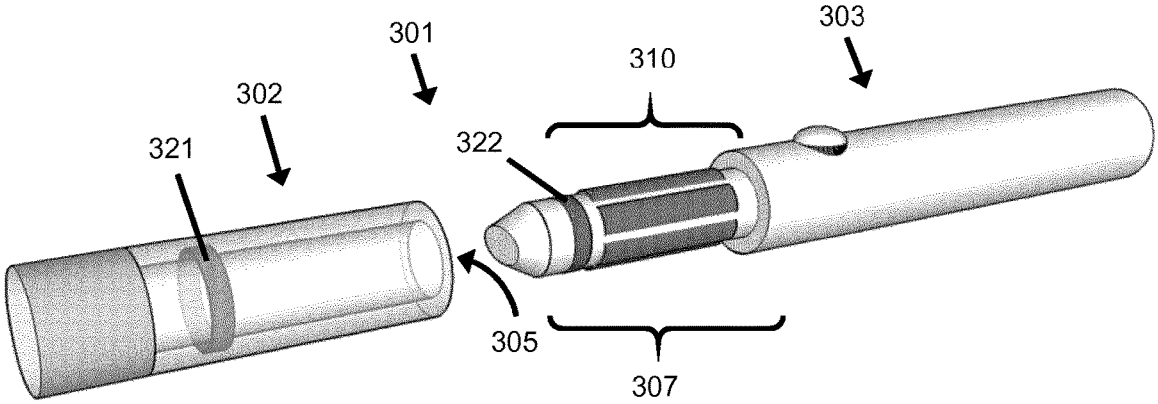
FIG. 7 is a schematic illustration of an electrically operated aerosol-generating system according to another embodiment of the present invention.

FIG. 7 shows an electrically operated aerosol-generating system 301 according to a second embodiment of the present invention. The electrically operated aerosol-generating system 301 comprises a tubular aerosol-generating article 302 and a main unit 303. The tubular aerosol-generating article 302 and the main unit 303 are substantially similar to the tubular aerosol-generating article 102 and the main unit 103 described above in relation to FIGS. 4 and 5, and where the same features are present like reference numerals have been used to refer to these features.

The tubular aerosol-generating article 302 comprises a first magnetic ring 321 circumscribing a proximal portion of the inner surface of the inner passage 305. The first magnetic ring 321 is comprised of a first magnetic material, such as cobalt ferrite.

The main unit 303 comprises a second magnetic ring 322 circumscribing a portion of the outer surface of the proximal portion 307. The second ring 322 is comprised of a second magnetic material. The second magnetic material may comprise the same magnetic material as the first magnetic material. The second magnetic material is configured and arranged to magnetically attract the first magnetic material when the first magnetic material is arranged at the outer surface of the proximal portion 307 of the main unit 303.

The second magnetic ring 322 is arranged at the proximal end of the proximal portion of the main unit 303, between the heating portion 310 and the proximal end of the proximal portion 307, such that the first magnetic ring 321 of the tubular aerosol-generating article 302 is arranged directly above the second magnetic ring 322 when the tubular aerosol-generating article 302 is fully received on the heating portion 310.

When the tubular aerosol-generating article 302 is fully received on the heating portion 310, the magnetic attraction between the first magnetic material and the second magnetic material applies a force on the tubular aerosol-generating article radially inwards, towards the heating portion 310. This retains the tubular aerosol-generating article 302 on the heating portion 310 of the main unit 303. The magnetic attraction between the first magnetic material and the second magnetic material is such that the user is required to apply a moderate force to the tubular aerosol-generating article 302, in a proximal direction, to remove the tubular aerosol-generating article 302 from the heating portion 310 of the main unit 303.

Figure 8:
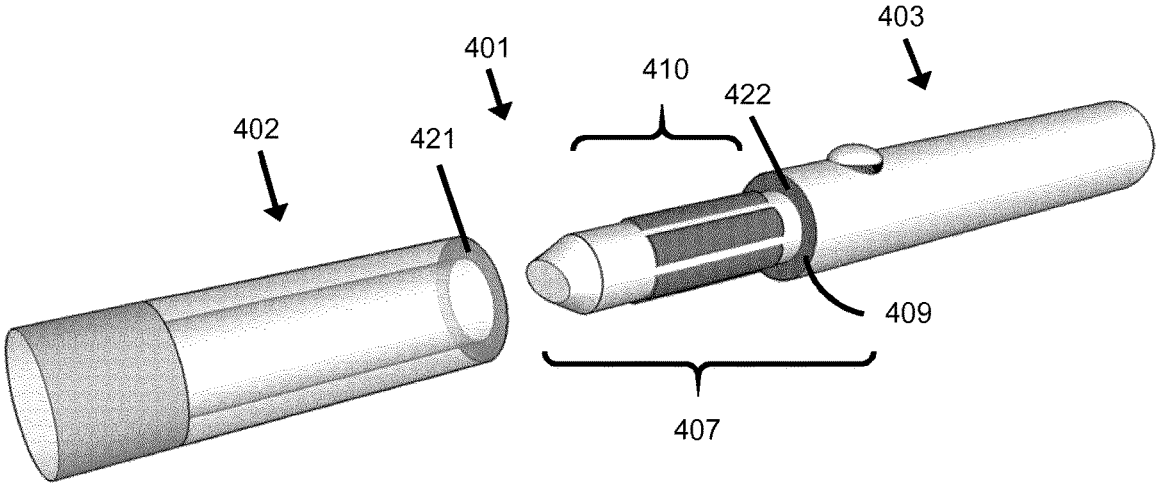
FIG. 8 is a schematic illustration of an electrically operated aerosol-generating system according to another embodiment of the present invention.

FIG. 8 shows an electrically operated aerosol-generating system 401 according to a third embodiment of the present invention. The electrically operated aerosol-generating system 401 comprises a tubular aerosol-generating article 402 and a main unit 403. The tubular aerosol-generating article 402 and the main unit 403 are substantially similar to the tubular aerosol-generating article 302 and the main unit 303 described above in relation to FIGS. 4 and 5, and where the same features are present like reference numerals have been used to refer to these features.

The tubular aerosol-generating article 402 comprises a first magnetic ring 421 that is substantially similar to the first magnetic ring 321 described above. However, the first magnetic ring 421 is arranged at the distal end face of the tubular aerosol-generating article. The main unit 403 also comprises a second magnetic ring 422 that is substantially similar to the second magnetic ring 322 described above. However, the second magnetic ring 422 is arranged on the shoulder 409 of the main unit.

When the tubular aerosol-generating article 402 is fully received on the heating portion 410 of the main unit 403, the first magnetic ring 421 is arranged adjacent to the second magnetic ring 422. In this arrangement, the magnetic attraction between the first magnetic material and the second magnetic material applies a force on the tubular aerosol-generating article in a distal direction, towards the shoulder 409 of the main unit. This retains the tubular aerosol-generating article 302 on the heating portion 410 of the main unit 403.

Figure 9:
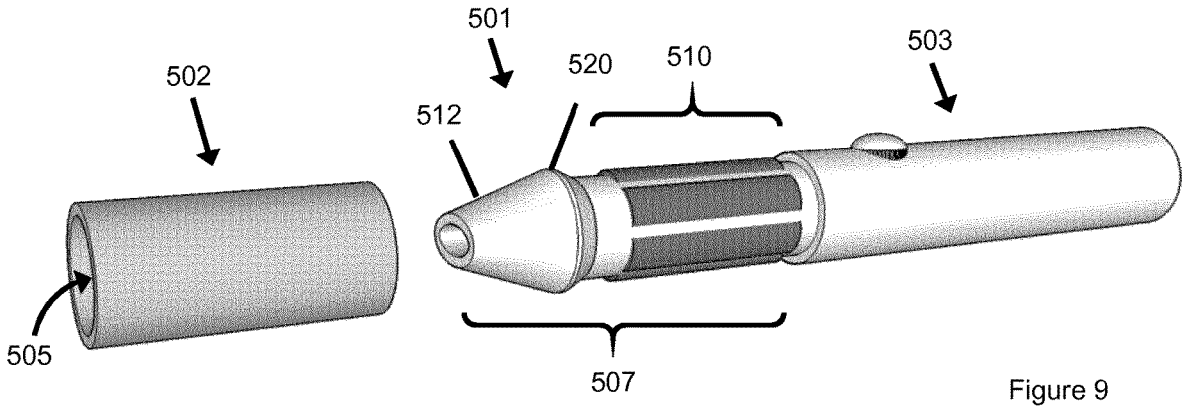
FIG. 9 is a schematic illustration of an electrically operated aerosol-generating system according to another embodiment of the present invention.
Figure 10:
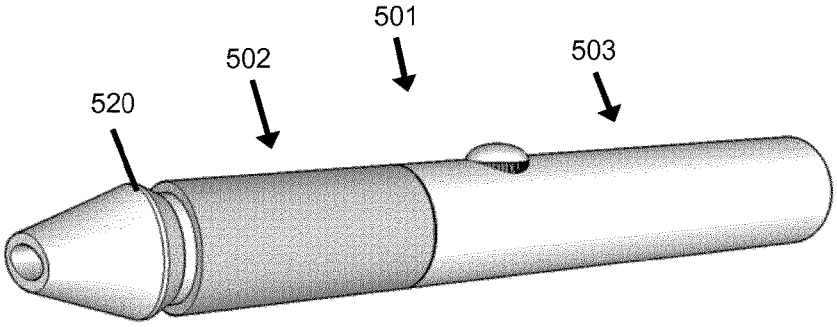
FIG. 10 is a schematic illustration of the electrically operated aerosol-generating system of FIG. 9, showing the tubular aerosol-generating article fully received on the main unit.

FIGS. 9 and 10 show an electrically operated aerosol-generating system 501 according to a fourth embodiment of the present invention.

The electrically operated aerosol-generating system 501 comprises a tubular aerosol-generating article 502 and a main unit 503. The tubular aerosol-generating article 502 and the main unit 503 are substantially similar to the tubular aerosol-generating article 2 and the main unit 3 described above in relation to FIGS. 1 to 3, and where the same features are present like reference numerals have been used to refer to these features.

The main unit 503 comprises an enlarged portion 520 at the proximal end of the proximal portion 507, between the mouthpiece 512 and the heating portion 510. The enlarged portion is a protrusion extending radially outwardly from the proximal portion 507 of the main unit 503 and substantially circumscribing the proximal portion 507. The width of the enlarged portion 520 is greater than the width of the heating portion 510. As such, the width of the enlarged portion 520 is greater than the width of the inner passage 505 of the tubular aerosol-generating article 502.

To assemble the electrically operated aerosol-generating system 501 for use, a user inserts the proximal portion 507 of the main unit 503 into either open end of the tubular aerosol-generating article 502. When the tubular aerosol-generating article encounters the enlarged portion 520, the user applies a moderate force on the tubular aerosol-generating article 502 in the direction towards the enlarged portion 520. This moderate force causes the tubular aerosol-generating article 502 to flex or deform radially outwardly, such that the width of the inner passage 505 is temporarily increased to accommodate the enlarged portion 520 of the main unit 503. The user slides the deformed tubular aerosol-generating article 502 over the enlarged portion 520, and onto the heating portion 510 of the main unit. The tubular aerosol-generating article 502 is also configured to be resilient, such that the inner passage 505 returns back to its original, un-deformed size once the tubular aerosol-generating article 502 is fully received on the heating portion 510 of the main unit 503.

As shown in FIG. 10, when the tubular aerosol-generating article 502 is fully received on the heating portion 505, the proximal end face of the tubular aerosol-generating article 502 engages or abuts the enlarged portion 520. As such, the enlarged portion 520 acts as a proximal stop to substantially prevent removal of the tubular aerosol-generating article 502 from the main unit 503.

To remove the tubular aerosol-generating article 502 from the heating portion 505, the user is required to apply a moderate force to the tubular aerosol-generating article 502 in a proximal direction towards the enlarged portion 520. This moderate force causes the tubular aerosol-generating article 502 to flex or deform so that the tubular aerosol-generating article 502 may slide over the enlarged portion 520 and off of the main unit 503.

Figure 11:
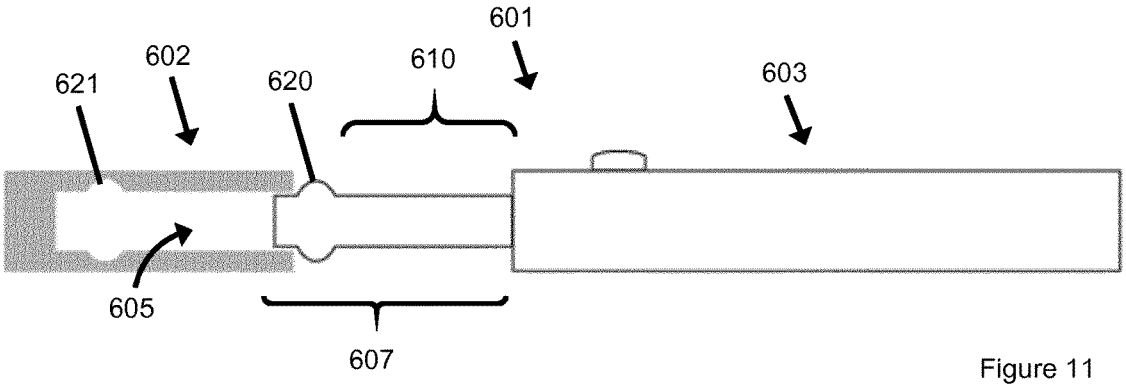
FIG. 11 is a schematic illustration of an electrically operated aerosol-generating system according to another embodiment of the present invention.
Figure 12:
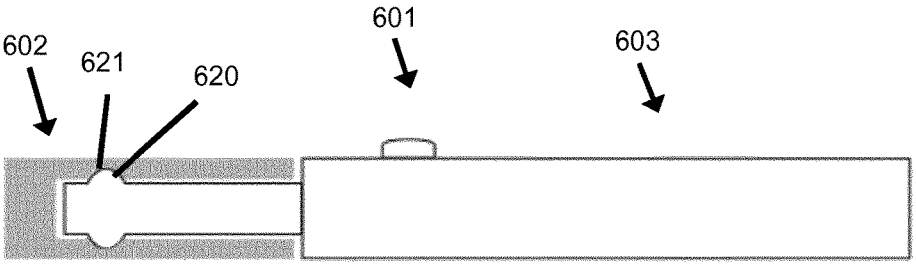
FIG. 12 is a schematic illustration of the electrically operated aerosol-generating system of FIG. 11, showing the tubular aerosol-generating article fully received on the main unit.

FIGS. 11 and 12 show an electrically operated aerosol-generating system 601 according to a fifth embodiment of the present invention.

The electrically operated aerosol-generating system 601 comprises a tubular aerosol-generating article 602 and a main unit 603. The tubular aerosol-generating article 602 and the main unit 603 are substantially similar to the tubular aerosol-generating article 102 and the main unit 103 described above in relation to FIGS. 4 and 5, and where the same features are present like reference numerals have been used to refer to these features.

The main unit 603 comprises an enlarged portion 620 at the proximal end of the proximal portion 607. The enlarged portion 620 is a protrusion extending radially outwardly from the proximal portion 607 of the main unit 603 and circumscribing the proximal portion 607. The width of the enlarged portion 620 is greater than the width of the heating portion 610. As such, the width of the enlarged portion 620 is greater than the width of the inner passage 605 of the tubular aerosol-generating article 602.

The tubular aerosol-generating article 602 comprises a recess 621 at the distal end of the inner passage 605. The shape and size of the recess 621 corresponds to the shape and size of the enlarged portion 620 of the main unit. As such, when the tubular aerosol-generating article 602 is received on the heating portion 610 of the main unit 603, the enlarged portion 620 fits inside the recess 621.

To assemble the electrically operated aerosol-generating system 601 for use, the proximal portion 607 of the main unit 603 is inserted into the open distal end of the tubular aerosol-generating article 602. When the tubular aerosol-generating article reaches the enlarged portion 620, the user may apply a moderate force on the tubular aerosol-generating article 602 towards the enlarged portion 620. This moderate force causes the tubular aerosol-generating article 602 to flex or deform radially outwardly, such that the width of the inner passage 605 is temporarily increased to accommodate the enlarged portion 620 of the main unit 603. The deformed tubular aerosol-generating article 602 is slid over the enlarged portion 620, and onto the heating portion 610 of the main unit. The tubular aerosol-generating article 602 is also configured to be resilient, such that the width of the inner passage 605 returns back to its original size once the tubular aerosol-generating article 602 is fully received on the heating portion 610 of the main unit 603.

As shown in FIG. 12, when the tubular aerosol-generating article 602 is fully received on the heating portion 605, the enlarged portion is received in the recess 621 of the inner passage 605. As such, the recess 621 engages with the enlarged portion 620 to substantially prevent removal of the tubular aerosol-generating article 502 from the main unit 603.

To remove the tubular aerosol-generating article 602 from the heating portion 605, a user applies a moderate force to the tubular aerosol-generating article 602, in a proximal direction, to cause the tubular aerosol-generating article 602 to flex or deform so that the tubular aerosol-generating article 602 slides over the enlarged portion 620 and off of the main unit 603.

It will be appreciated that any number of protrusions and enlarged portions may be provided on the proximal portion of the main unit. It will also be appreciated that the one or more protrusions or enlarged portions may be arranged at any position along the length of the proximal portion of the main unit. Similarly, any suitable number of recesses may be provided in the inner passage of the tubular aerosol-generating article. The recesses may be arranged at any suitable position along the length of the inner passage corresponding to the position of the one or more protrusions and enlarged portions of the main unit.

FIGS. 13 through 16 show an electrically operated aerosol-generating system 701 according to a sixth embodiment of the present invention.

The electrically operated aerosol-generating system 701 comprises a tubular aerosol-generating article 702 and a main unit 703. The tubular aerosol-generating article 702 and the main unit 703 are substantially similar to the tubular aerosol-generating article 2 and the main unit 3 described above in relation to FIGS. 1 to 3, and where the same features are present like reference numerals have been used to refer to these features.

The tubular aerosol-generating article 702 comprises deformable portions (not shown) at opposite sides of the article. The deformable portions are compressible sections formed of a compressible aerosol-forming substrate. By providing compressible portions of aerosol-forming substrate at either side of the article, the article is configured to be flattened into a storage configuration when the deformable portions are compressed, and opened up into an annular body with an inner passage 705 in a use configuration when the deformable portions are expanded.

Before use, the deformable portions of the tubular aerosol-generating article 702 are in a compressed state such that the aerosol-generating article 702 is in the storage configuration. In the storage configuration, the tubular aerosol-generating article 702 is flattened and comprises two substantially planar, opposing faces 720, as shown in FIG. 13.

Figure 14:
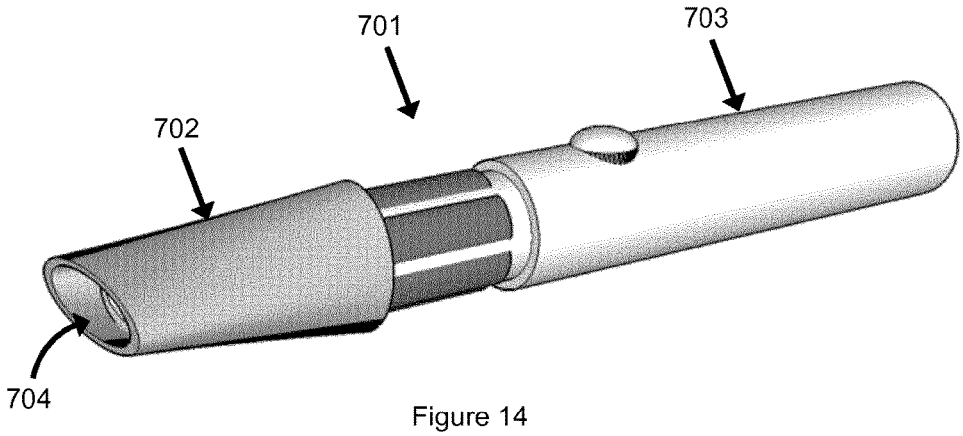
FIG. 14 is a schematic illustration of the electrically operated aerosol-generating system of FIG. 13, showing the tubular aerosol-generating article partially received on the main unit.

To assemble the electrically operated aerosol-generating system 701 for use, a user squeezes the tubular aerosol-generating article 702 inwardly at either side of the substantially planar opposing faces 720. The application of the moderate, inward force causes the opposing planar faces 720 to separate and deform radially outwards and causes the deformable portions to expand. When the inner passage 705 is partially open, the proximal end of the main unit 703 is inserted into either open end of the inner passage 705, as shown in FIG. 14. The user slides the tubular aerosol-generating article 702 over the proximal portion of the main unit 702, towards the distal end, until the tubular aerosol-generating article 702 is fully received on the heating portion of the main unit 701, as shown in FIG. 15. When the tubular aerosol-generating article 702 is fully received on the heating portion of the main unit 703, the inner passage 705 is fully open and the tubular aerosol-generating article 702 is configured in the use configuration.

FIG. 16 shows multiple aerosol-generating articles 702 stacked together in the storage configuration. The substantially planar faces 720 of the flattened article 702 enable the aerosol-generating articles 702 to be closely or tightly stacked together. Each tubular aerosol-generating article 702 may be individually packaged in the storage configuration.

In the arrangement shown in FIG. 16, the stacked aerosol-generating articles 702 are arranged in a rectangular box 730 comprising an open rectangular body 731 enclosed by an outer sleeve 732 that is slidably received on the open rectangular box 731. The packaging 330 may be similar to the packaging used for conventional smoking articles, such as cigarettes.

It will be appreciated that the tubular aerosol-generating article may be deformable by other means. For example, the tubular aerosol-forming substrate may be flexible. For example, the tubular aerosol-forming substrate may comprise two or more pieces, the two or more pieces being movable with respect to each other to deform the tubular aerosol-generating article between the use configuration and the storage configuration.

It will be appreciated that the tubular articles 102 in FIGS. 1 through 5, can, in an embodiment, be formed from the aerosol-generating articles 702, which are flat in the storage configuration.

It will be appreciated that the tubular aerosol-generating article may be resilient and biased into the storage configuration. The resilience of the tubular aerosol-generating article may result from the outer wrapper, which may be comprised of an elastic material. The resilience of the tubular aerosol-generating article may result from a structure arranged inside the tubular aerosol-generating article, such as a sprung wire frame. As such, when the tubular aerosol-generating article is received on the heating portion of the main unit, the tubular aerosol-generating article may apply a force radially inwards, towards the heating portion of the main unit. When the tubular aerosol-generating article is fully received on the heating portion of the main unit, the radial inward force from the tubular aerosol-generating article may secure the tubular aerosol-generating article on the heating portion of the main unit. The resilience and bias into the storage configuration may provide the at least one retaining feature of the present invention.

It will be appreciated that the examples described herein are straightforward examples, and that modifications may be made to the illustrated circuits to provide different or more sophisticated functionality. It will be appreciated that features described herein with reference to one embodiment may be applied to other embodiments without departing from the scope of the invention.

The invention claimed is:

1. An electrically operated aerosol-generating system, comprising:

a main unit comprising a heating portion disposed at an outer surface of the main unit, the heating portion comprising one or more electric heaters; and a tubular aerosol-generating article comprising:

a tubular aerosol-forming substrate, and an inner passage, wherein:

the inner passage of the tubular aerosol-generating article is configured to receive the heating portion of the main unit, the one or more electric heaters are configured to heat the tubular aerosol-forming substrate when the tubular aerosol-generating article is received on the heating portion of the main unit, at least one of the main unit and the tubular aerosol-generating article comprises at least one retaining feature configured to removably retain the tubular aerosol-generating article on the heating portion of the main unit when the tubular aerosol-generating article is received on the heating portion of the main unit, and the at least one retaining feature comprises:

a first magnetic material disposed on the tubular aerosol-generating article, and a second magnetic material disposed on the main unit.

2. The electrically operated aerosol-generating system according to claim 1, wherein the at least one retaining feature comprises one or more protrusions configured to engage with the tubular aerosol-generating article when the tubular aerosol-generating article is received on the heating portion of the main unit.

3. The electrically operated aerosol-generating system according to claim 2, wherein the one or more protrusions substantially circumscribe the main unit.

4. The electrically operated aerosol-generating system according to claim 2, wherein the tubular aerosol-generating article further comprises one or more recesses in the inner passage, the one or more recesses being configured to receive the one or more protrusions of the main unit when the tubular aerosol-generating article is received on the heating portion of the main unit.

5. The electrically operated aerosol-generating system according to claim 1, wherein at least a portion of the first magnetic material is arranged to be adjacent to at least a portion of the second magnetic material when the tubular aerosol-generating article is received on the heating portion of the main unit.

6. The electrically operated aerosol-generating system according to claim 1, wherein either the first and the second magnetic materials comprise the same magnetic material, or the first and the second magnetic materials comprise different magnetic materials.

7. The electrically operated aerosol-generating system according to claim 1, wherein the tubular aerosol-generating article is deformable between:

a use configuration, wherein the inner passage of the article is configured to receive a heating portion of the main unit of an electrically operated aerosol-generating system; and a storage configuration, wherein the tubular aerosol-generating article is flattened.

8. The electrically operated aerosol-generating system according to claim 7, wherein the tubular aerosol-generating article is resiliently biased from the use configuration towards the storage configuration.

9. The electrically operated aerosol-generating system according to claim 1, wherein the at least one retaining feature includes protrusions, or recesses, or magnetic materials, or resilient biasing, or a combination thereof.

10. A tubular aerosol-generating article for an electrically operated aerosol-generating system according to claim 1, wherein the tubular aerosol-generating article comprises:

the tubular aerosol-forming substrate, the inner passage of the tubular aerosol-forming substrate being configured to receive the heating portion of the main unit of the electrically operated aerosol-generating system; and the at least one retaining feature configured to removably retain the tubular aerosol-generating article on the heating portion of the main unit when the tubular aerosol-generating article is received on the heating portion of the main unit.

11. A main unit for an aerosol-generating system according to claim 1, wherein the main unit comprises:

the heating portion at an outer surface of the main unit, the heating portion comprising the one or more electric heaters; and the at least one retaining feature configured to removably retain the tubular aerosol-generating article on the heating portion of the main unit when the tubular aerosol-generating article is received on the heating portion of the main unit.

12. The main unit according to claim 11, wherein the main unit further comprises a proximal end and a distal end, and the at least one retaining feature is disposed between the heating portion and the proximal end of the main unit.

13. The main unit according to claim 11, wherein the main unit further comprises a proximal end and a distal end, and the at least one retaining feature is disposed between the heating portion and the distal end of the main unit.

* * * * *